US011175622B2

(12) United States Patent
Totsuka

(10) Patent No.: US 11,175,622 B2
(45) Date of Patent: Nov. 16, 2021

(54) IMAGE FORMATION APPARATUS WITH MOVABLE UNIT SUPPORTING IMAGE FORMATION UNIT

(71) Applicant: Oki Data Corporation, Tokyo (JP)

(72) Inventor: Toshiyuki Totsuka, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/070,920

(22) Filed: Oct. 15, 2020

(65) Prior Publication Data

US 2021/0116846 A1 Apr. 22, 2021

(30) Foreign Application Priority Data

Oct. 21, 2019 (JP) ..... JP2019-191706

(51) Int. Cl.
*G03G 21/00* (2006.01)
*G03G 21/18* (2006.01)
*G03G 21/16* (2006.01)

(52) U.S. Cl.
CPC ..... *G03G 21/1842* (2013.01); *G03G 21/1628* (2013.01); *G03G 2221/1684* (2013.01); *G03G 2221/1687* (2013.01); *G03G 2221/1869* (2013.01)

(58) Field of Classification Search
CPC ..... G03G 21/1628; G03G 21/1842; G03G 2221/1684; G03G 2221/1687; G03G 2221/1869
USPC ..... 399/110, 111, 112
See application file for complete search history.

(56) References Cited

U.S. PATENT DOCUMENTS

2007/0230998 A1* 10/2007 Ishii ..... G03G 21/1623 399/111
2009/0190954 A1* 7/2009 Okabe ..... G03G 15/1615 399/111
2011/0182612 A1* 7/2011 Kamimura ..... G03G 21/1676 399/110
2012/0183324 A1* 7/2012 Sato ..... G03G 15/0194 399/110
2012/0251160 A1* 10/2012 Sato ..... G03G 21/1633 399/101

(Continued)

FOREIGN PATENT DOCUMENTS

JP 2012-230280 A 11/2012

*Primary Examiner* — Robert B Beatty
(74) *Attorney, Agent, or Firm* — Metrolex Ip Law Group, PLLC

(57) ABSTRACT

An image formation apparatus according to an embodiment may include: an apparatus body; an image formation unit configured to form an image; a movable unit accommodated in the apparatus body and supporting the image formation unit; a guide part configured to guide the movable unit from an inside of the apparatus body in a pull-out direction; a first rotatable member provided to the apparatus body and configured to guide the movable unit in the pull-out direction; and a second rotatable member provided to the movable unit and configured to be engaged with the guide part at a position on an upstream side of the first rotatable member in the pull-out direction. In a state where the movable unit is guided by the first rotatable member with the movable unit being moved in the pull-out direction, the second rotatable member and the guide part are disengaged from each other.

20 Claims, 16 Drawing Sheets

(56) References Cited

U.S. PATENT DOCUMENTS

2012/0328329 A1* 12/2012 Sato ..... G03G 21/1671
399/117

* cited by examiner

IMAGE FORMATION APPARATUS WITH MOVABLE UNIT SUPPORTING IMAGE FORMATION UNIT

CROSS REFERENCE TO RELATED APPLICATIONS

This application claims priority based on 35 USC 119 from prior Japanese Patent Application No. JP2019-191706 filed on Oct. 21, 2019, entitled "IMAGE FORMATION APPARATUS", the entire contents of which are incorporated herein by reference.

BACKGROUND

The disclosure relates to an image formation apparatus.

In a related art, an electrophotographic image formation apparatus forms a developer image (a toner image) by an image formation unit and transfer the developer image to a medium such as print paper, or the like. There has been an image formation apparatus in which an image formation unit is able to be pulled out along plural pairs of slide rails from an apparatus body, in order to facilitate replacement of the image formation unit (see, for example, Patent Document 1).

Patent Document 1: Japanese Patent Application Publication No. 2012-230280 (see FIG. 7)

SUMMARY

However, in the related art, the plural pairs of the slide rails are provided to pull out the image formation unit, and thus the image formation apparatus may be enlarged.

An object of an aspect of one or more embodiments is to provide an image formation apparatus having a configuration capable of pulling out an image formation unit without enlarging the image formation apparatus.

An aspect of an embodiment may be an image formation apparatus that may include: an apparatus body; an image formation unit configured to form an image; a movable unit accommodated in the apparatus body and supporting the image formation unit; a guide part configured to guide the movable unit from an inside of the apparatus body in a pull-out direction; a first rotatable member provided to the apparatus body and configured to guide the movable unit in the pull-out direction; and a second rotatable member provided to the movable unit and configured to be engaged with the guide part at a position on an upstream side of the first rotatable member in the pull-out direction. In a state where the movable unit is guided by the first rotatable member with the movable unit being moved in the pull-out direction, the second rotatable member and the guide part are disengaged from each other.

According to the aspect, upon pulling out the movable unit from the apparatus body, the second rotatable member is engaged with the guide part and then the second rotatable member and the guide part are disengaged from each other in the state where the movable unit is guided by the first rotatable member. Accordingly, a configuration capable of pulling out the image formation unit from the apparatus body can be realized without increasing the size of the image formation apparatus.

DETAILED DESCRIPTION

Figure 1:
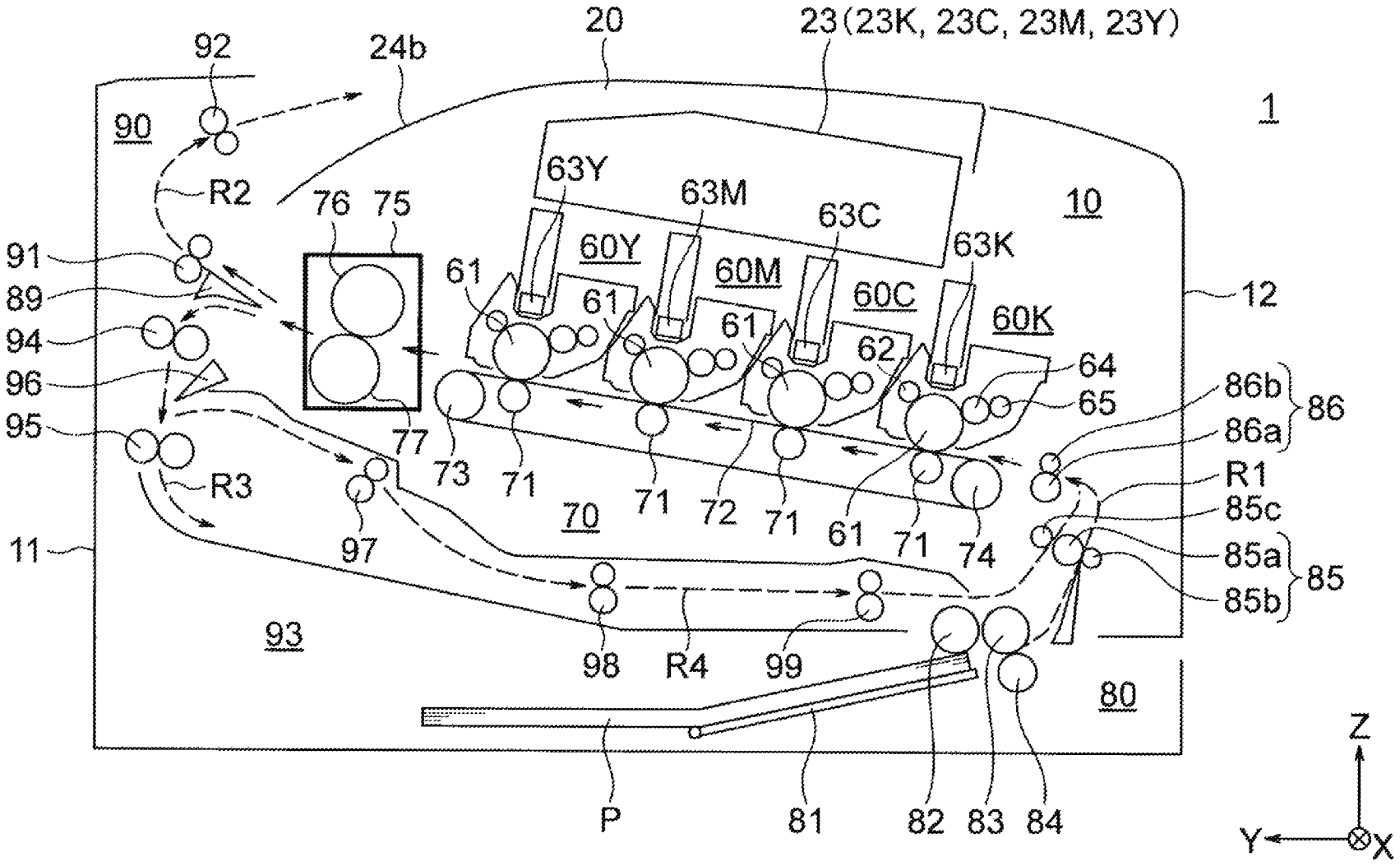
FIG. 1 is a diagram illustrating an overall configuration of an image formation apparatus according to an embodiment.

Descriptions are provided hereinbelow for one or more embodiments based on the drawings. In the respective drawings referenced herein, the same constituents are designated by the same reference numerals and duplicate explanation concerning the same constituents is omitted. All of the drawings are provided to illustrate the respective examples only. The invention is not limited to one or more embodiments described below.

Overall Configuration of Image Formation Apparatus

First, the overall configuration of an image formation apparatus 1 according to an embodiment is explained. FIG.

1 is a diagram illustrating an overall configuration of the image formation apparatus 1 according to an embodiment. The image formation apparatus 1 is an electrophotographic printer which forms (prints) a color image, in this example. The image formation apparatus 1 include a medium conveyance mechanism 80 to convey a medium P such as printing paper or the like, an image formation section 10 to form a toner image (developer image) on the medium P, a fixation device 75 to fix the toner image to the medium P, and a medium discharging mechanism 90.

The medium conveyance mechanism 80 includes a medium tray 81 (a paper tray) accommodating therein the media P, a pickup roller 82 provided in contact with the media accommodated in the medium tray 81, a feed roller 83 provided in the vicinity of the pickup roller 82, and retard roller 84 provided with being opposed to the feed roller 83.

The medium tray 81 accommodates the media P, such as printing paper or the like, stacked therein. The pickup roller 82 rotates with being in contact with the medium P on the medium tray 81, and thereby takes out the medium P from the medium tray 81. The feed roller 83 feeds the medium P that is taken out by the pickup roller 82 to the conveyance path R1. The retard roller 84 is rotated in a direction opposite to the feed direction by the feed roller 83 to apply a resistance to the medium P, so as to prevent an overlapped feeding of the media P.

The medium conveyance mechanism 80 includes, along the conveyance path R1, a conveyance roller pair 85 and a conveyance roller pair 86. The conveyance roller pair 85 includes a drive roller 85*a* and a pinch roller 85*b*. The conveyance roller pair 85 corrects the skew of the medium P when the leading end of the medium P comes in contact with a nip portion between the rollers 85*a* and 85*b*, and then starts rotating at a predetermined time after the leading end of the medium P comes in contact with the nip portion between the rollers 85*a* and 85*b*, so as to convey the medium P. The conveyance roller pair 86 includes a drive roller 86*a* and a pinch roller 86*b* and conveys the medium P to the image formation section 10.

The image formation section 10 includes four process units 60K, 60C, 60M, and 60Y serving as image formation units that form toner images of black, cyan, magenta, and yellow, and a transfer unit 70 that transfers the toner images to the medium P. Exposure heads 63K, 63C, 63M, and 63Y serving as exposure devices are provided being opposed to the photosensitive drums 61 of the process units 60K, 60C, 60M, and 60Y, respectively.

The process units 60K, 60C, 60M, and 60Y are arranged in this order in a conveyance direction of the medium P (the direction from the right side to the left side in the FIG. 1). The process units 60K, 60C, 60M, and 60Y have the same configuration except for the colors of the toners. Therefore, when the process units 60K, 60C, 60M, and 60Y do not have to be distinguished for explanation, the process units 60K, 60C, 60M, and 60Y may be simply referred to as a process unit 60. Also, when the exposure heads 63K, 63C, 63M, and 63Y do not have to be distinguished for explanation, the exposure heads 63K, 63C, 63M, and 63Y may be simply referred to as an exposure head 63.

Each of the process units 60 includes a photosensitive drum 61 serving as an image carrier, a charge roller 62 serving as a charging member, a development roller 64 serving as a developer carrier or a development device, and a supply roller 65 serving as a supply member.

The photosensitive drum 61 is formed with a photosensitive layer (a charge generation layer and a charge transport layer) layered on the surface of a cylindrical conductive base body. The photosensitive drum 61 is rotated in the rotational direction (a clockwise direction in FIG. 1). The charge roller 62 uniformly charges the surface of the photosensitive drum 61. The exposure head 63 exposes light onto the uniformly-charged surface of the photosensitive drum 61, so as to form an electrostatic latent image on the photosensitive drum 61.

The development roller 64 supplies and attaches a toner serving as a developer to the electrostatic latent image formed on the photosensitive drum 61, to thereby form a toner image serving as a developer image on the photosensitive drum 61. The supply roller 65 supplies the toner to the development roller 64.

At an upper portion of the image formation section 10, toner cartridges 23K, 23C, 23M, and 23Y serving as developer containers are provided. The toner cartridges 23K, 23C, 23M, and 23Y contain therein toners of black (K), cyan (C), magenta (M), and yellow (Y), respectively. The toner cartridges 23K, 23C, 23M, and 23Y are attached to a top cover unit 20 which is described later. When the toner cartridges 23K, 23C, 23M, and 23Y do not have to be distinguished for explanation, the toner cartridges 23K, 23C, 23M, and 23Y may be simply referred to as a toner cartridge 23.

The exposure head 63 includes, for example, an array of light emitting elements such as LEDs (light emitting diodes), and a lens array focuses lights emitted from the light emitting elements on the surface of the photosensitive drum 61. The exposure head 63 exposes the surface of the photosensitive drum 61 with the lights to thereby form the electrostatic latent image on the surface of the photosensitive drum 61. The exposure head 63 is suspended and supported by the top cover unit 20.

The transfer unit 70 includes an endless transfer belt 72, a drive roller 73 and a tension roller 74 around which the transfer belt 72 is wound, and transfer rollers 71, serving as transfer members, opposed to the photosensitive drums 61 of the process unit 60K, 60C, 60M, and 60Y, respectively, with the transfer belt 72 sandwiched therebetween.

The transfer belt 72 runs (rotates) in the state where the medium P is attracted to the surface of the transfer belt 72 by electrostatic force. The drive roller 73 is rotated in the counterclockwise direction in FIG. 1 to run (convey) the transfer belt 72. The tension roller 74 applies the tension to the transfer belt 72. The transfer rollers 71 receive the transfer voltage and thus transfer the toner images from the photosensitive drums 61 to the medium P.

The transfer unit 70 is a unit detachable from a housing 11 of the image formation apparatus 1. A handle 701 (see FIG. 2), which is gripped by the user upon the attachment and detachment of the transfer unit 70, is provided at the end of the transfer unit 70 on the side of the conveyance rollers 86.

The fixation device 75 is arranged on the downstream side of the image formation section 10 in the conveyance direction of the medium P. The fixation device 75 includes a fixation roller 76 including therein a heater and a pressure roller 77 pressed against the fixation roller 76, for example. The fixation roller 76 and the pressure roller 77 apply pressure and heat on the toner image transferred on the medium P, and thereby fix the image on the medium P.

The medium discharging mechanism 90 is arranged on the downstream side of the fixation device 75 in the conveyance direction of the medium P, and includes two discharge roller pairs 91 and 92. The discharge roller pair 91 and the discharge roller pair 92 conveys the medium conveyed from the fixation device 75 along the discharge path R2 and thereby discharges the medium P out of the image formation apparatus 1. The top cover of the image formation apparatus 1 is formed with a stacker 24*b* on which the media P discharged by the discharge roller pairs 91 and 92 are stacked and accumulated.

For double-sided printing, the image formation apparatus 1 includes a reconveyance mechanism 93 that conveys the medium P having the toner image being fixed on the front surface to an upstream portion of the conveyance path R1 with the medium P being reversed upside down. Further, a switching guide 89 is provided on the downstream side of the fixation device 75. The switching guide 89 guides the medium P conveyed from the fixation device 75 to the medium discharging mechanism 90 (the discharge path R2) or the reconveyance mechanism 93.

The reconveyance mechanism 93 includes conveyance rollers 94 and 95 and a switching guide 96 that once conveys the medium P to the retreat path R3 to switch the leading end and the tail end of the medium P, and conveyance rollers 97, 98 and 99 that convey the medium P along a return path R4. The return path R4 is join to the conveyance path R1 at a position upstream of the conveyance roller 86 in the conveyance path R1. In the vicinity of an outlet of the return path R4, a pinch roller 85*c* is provided which is in contact with the drive roller 85*a* from the opposite side of the pinch roller 85*b*.

After being conveyed by the conveyance rollers 97, 98, and 99 in the return path R4, the medium P is fed into the conveyance path R1 by the conveyance rollers 85 (the drive roller 85*a* and the pinch roller 85*c*), and then conveyed along the conveyance path R1 to the image formation section 10 again by the conveyance roller 86. Note that in a case where the image formation apparatus 1 does not have a double-side print function, the reconveyance mechanism 93 may not be needed.

In FIG. 1, it is assumed that the image formation apparatus 1 is placed in an X-Y plane (in this case, a horizontal plane). The axial direction of the photosensitive drum 61 and the rollers of the image formation apparatus 1 is oriented in a X direction in this example. A widthwise direction of the image formation apparatus 1 and a widthwise direction of the medium P is oriented in the X direction. A direction orthogonal to the X direction in the X-Y plane is referred to as a Y direction (a front-rear direction in this example). A direction orthogonal to the X-Y plane is referred to as a Z direction (a vertical direction in this example). These X, Y, and Z directions dose not limit the orientation of the image formation apparatus 1.

Note that the arrangement direction of the process units 60K, 60C, 60M, and 60Y is inclined with respect to the X-Y plane in FIG. 1, but does not necessarily have to be inclined.

Figure 2:
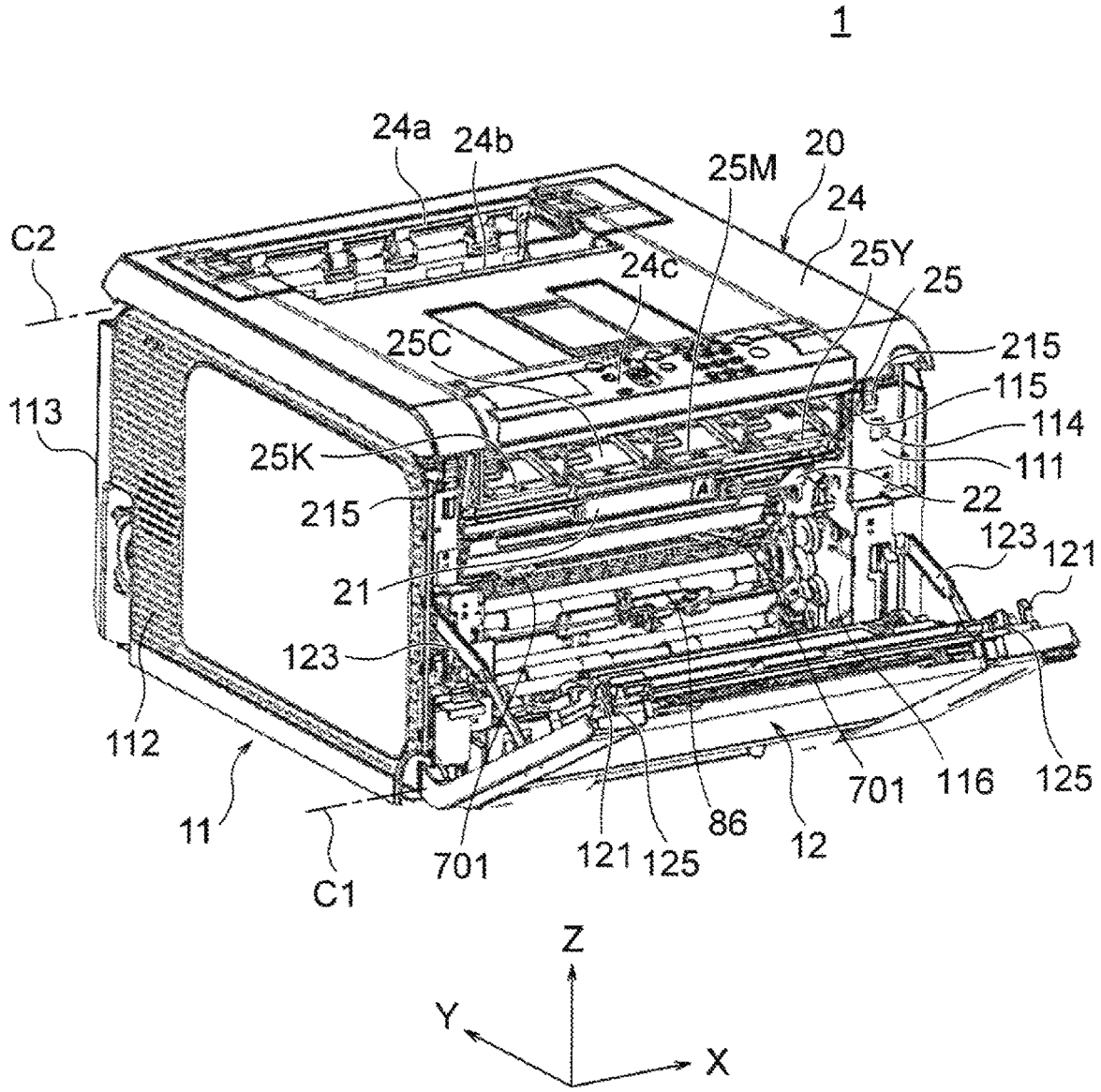
FIG. 2 is a diagram illustrating a perspective view of an exterior of the image formation apparatus according to an embodiment.

FIG. 2 is a diagram illustrating a perspective view of the image formation apparatus 1 with the front cover 12 opened. The image formation apparatus 1 includes a housing 11 as an apparatus main body. The housing 11 includes a pair of side walls 112 on both sides of the housing 11 in the X direction and a rear wall 113 on a rear side (+Y side) of the housing 11, with the upper side (+Z side) and the front side (−Y side) of the housing 11 being opened.

A top cover unit 20 (a cover unit) is attached to and configured to open and close the upper opening (+Z side) of the housing 11. A front cover 12 (a cover member) is attached to and configured to open and close the front opening (−Y side) of the housing 11.

The front cover 12 is attached to the housing 11 such that the front cover 12 is rotatable with respect to the housing 11 about a rotational axis C1 extending in the X direction. The rotational axis C1 is provided at a position where the front end (the end in the −Y direction) and the lower end (the end in the −Z direction) of the housing 11 meet.

Lock members 121 for locking the front cover 12 to the housing 11 are respectively provided near both end portions of the front cover 12 in the X direction. When the lock members 121 are engaged with the openings 114 formed at both end portions of the front wall 111 of the housing 11, the front cover 12 is locked to the housing 11.

At a front surface of the front cover 12, operation levers for the user to operate (manipulate) the lock members 121 are provided. When the lock members 121 are disengaged from the openings 114 by the user operation of the operation levers, the lock of the front cover 12 with respect to the housing 11 is released so that the front cover 12 can be opened.

Further, stays 123 are provided in the vicinity of both ends of the front cover 12 in the X direction. Each stay 123 has one end thereof connected to the front cover 12 and the other end thereof connected to the housing 11. The stay 123 supports the front cover 12 with respect to the housing 11 at a predetermined inclination angle with the front cover 12 opened.

Further, the upper end portion of the front cover 12 (the end portion of the front cover 12 on the side opposite to the rotation axis C1) is provided with reception portions 125 that support the basket 40 (see FIG. 14) being pulled out from the rotatable frame 30 with the front cover 12 being opened.

Figure 3:
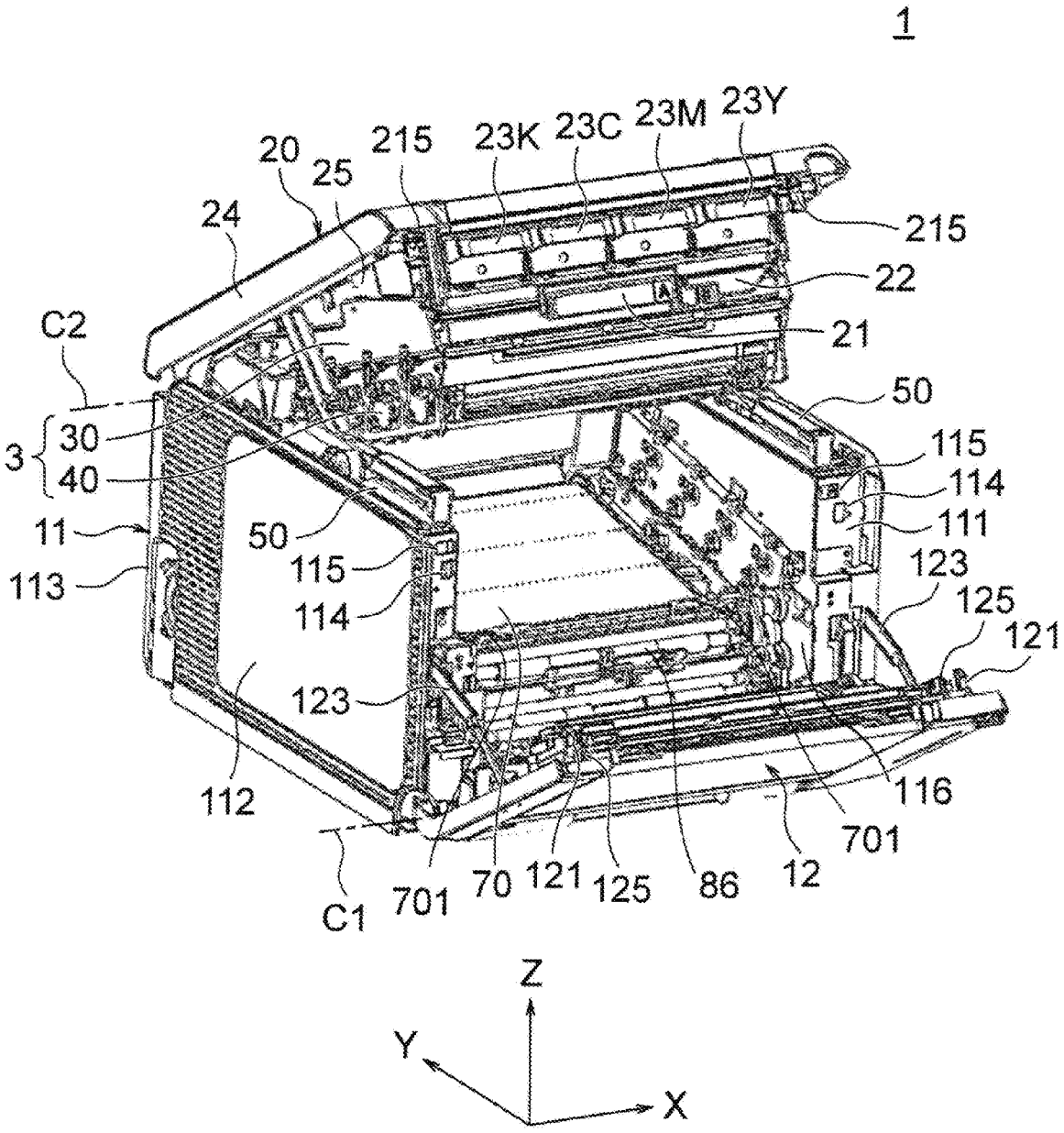
FIG. 3 is a diagram illustrating a perspective view of the image formation apparatus with a front cover, a top cover unit, and a basket unit being opened according to an embodiment.
Figure 4:
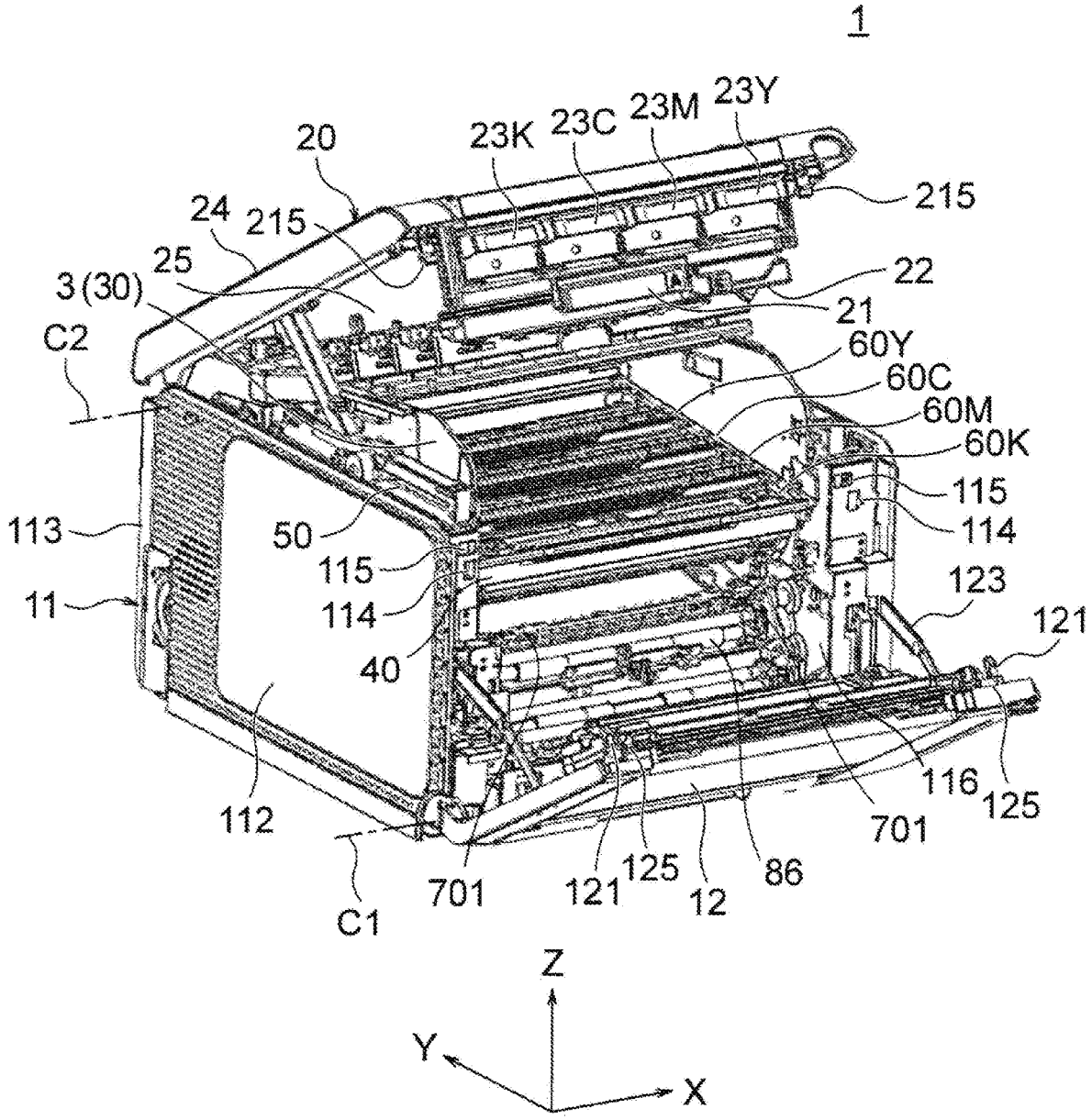
FIG. 4 is a diagram illustrating a perspective view of the image formation apparatus with the front cover and the top cover unit being opened according to an embodiment.

FIG. 3 is a diagram illustrating a perspective view of the image formation apparatus 1 with the front cover 12 being opened and the top cover unit 20 and the basket unit 3 (described later) being coupled (engaged) with each other and opened. FIG. 4 is a diagram illustrating a perspective view of the image formation apparatus 1 with being the front cover 12 opened and with the top cover unit 20 and the basket unit 3 being opened in a state where the top cover unit 20 and the basket unit 3 are decoupled (disengaged) from each other Among the components of the image formation apparatus 1, the toner cartridges 23K, 23C, 23M, and 23Y and the exposure heads 63K, 63C, 63M, and 63Y (see FIG. 1) are held by the top cover unit 20. The toner cartridges 23K, 23C, 23M, and 23Y are arranged in the X direction and attached to the top cover unit 20.

A basket unit 3 serving as an open/close unit, in which the process units 60K, 60C, 60M, and 60Y are mounted, is provided in the housing 11. The basket unit 3 includes a basket 40 as a movable unit that holds the process units 60K, 60C, 60M, and 60Y, and a rotatable frame 30 that holds the basket 40. The total weight of the process units 60K, 60C, 60M, and 60Y held by the basket 40 is, for example, 3 Kg.

The top cover unit 20 and the basket unit 3 are rotatable (openable and closable) about the common rotational axis C2 extending in the X direction. The rotational axis C2 is provided at a position where the upper end (the end in the +Z direction) and at the rear end (the end in the +Y direction) of the housing 11 meet each other.

As illustrated in FIG. 3, the top cover unit 20 and the basket unit 3 are coupled with each other to be opened and closed. In the state where the upper side of the transfer unit 70 is exposed, a jammed medium P can be removed or the transfer unit 70 can be replaced.

As illustrated in FIG. 4, the top cover unit 20 can be opened and closed in the state where the top cover unit 20 and the basket unit 3 are decoupled from each other. In this state, the upper side of the basket unit 3 is exposed and thus the process units 60K, 60C, 60M, and 60Y held in the basket unit 3 can be replaced from the basket unit 3. This is described in detail later.

Top Cover Unit

Next, the configuration of the top cover unit 20 is explained. As described above, the top cover unit 20 is provided on the upper side of the housing 11 so as to be rotatable (openable and closable) about the rotation axis C2.

As illustrated in FIG. 3, the top cover unit 20 has a cover portion 24 and a frame portion 25. The frame portion 25 is a frame including cartridge holding portions 25K, 25C, 25M and 25Y (see FIG. 2) which hold the toner cartridges 23K, 23C, 23M and 23Y, respectively. The cover portion 24 covers the upper side (+Z side) of the frame portion 25.

As illustrated in FIG. 2, the cover portion 24 includes an opening 24*a* for allowing the medium P discharged from the medium discharging mechanism 90 (see FIG. 1) to pass through, and the stacker 24*b* on which the discharged medium P is placed. The front end portion of the cover portion 24 is provided with an operation panel 24*c* including a display and operation keys.

The cartridge holding portions 25K, 25C, 25M, and 25Y are arranged in the X direction, and hold the toner cartridges 23K, 23C, 23M, 23Y (FIG. 3) to be slidable in the Y direction. The toner cartridges 23K, 23C, 23M, and 23Y can be pulled out from the front surface (the end surface in the −Y direction) of the top cover unit 20.

The toner cartridges 23K, 23C, 23M and 23Y can be removed from the top cover unit 20 and attached to the top cover unit 20 in a state where only the front cover 12 is open and the top cover unit 20 is closed.

As illustrated in FIG. 2, provided are on the front surface of the top cover unit 20, a first operation lever 21 that is operated by the user when opening the top cover unit 20 and a second operation lever 22 that is operated by the user when decoupling the top cover unit 20 and the basket unit 3 from each other.

The first operation lever 21 interlocks with (moves in conjunction with) lock portions 215 configured to be engaged with openings 115 formed in the housing 11. The top cover unit 20 is locked to the housing 11 when the lock portions 215 are engaged with the openings 115. When the user pulls the first operation lever 21 forward (−Y direction), the lock portions 215 move out of the openings 115, so as to release the lock of the top cover unit 20 with respect to the housing 11.

The second operation lever 22 interlocks with (moves in conjunction with) a shutter configured to block and open a toner transport path from the toner cartridge 23 to the process unit 60. When the second operation lever 22 is in a position pushed in the +Y direction (coupling position), the toner transport path is in communication (in which the toner can be conveyed), and the top cover unit 20 and the basket unit 3 are coupled with each other. When the user pulls the second operation lever 22 forward (−Y direction), the shutter blocks (closes) the toner transport path, and the coupling between the top cover unit 20 and the basket unit 3 is released.

The operation levers 21 and 22 are arranged below the cartridge holding portions 25K, 25M, 25C and 25Y (−Z direction) so as not to interfere with the attachment and detachment of the toner cartridges 23K, 23C, 23M and 23Y. The detailed description of the configuration of each of the operation levers 21 and 22 will be omitted.

Basket Unit

Figure 5:
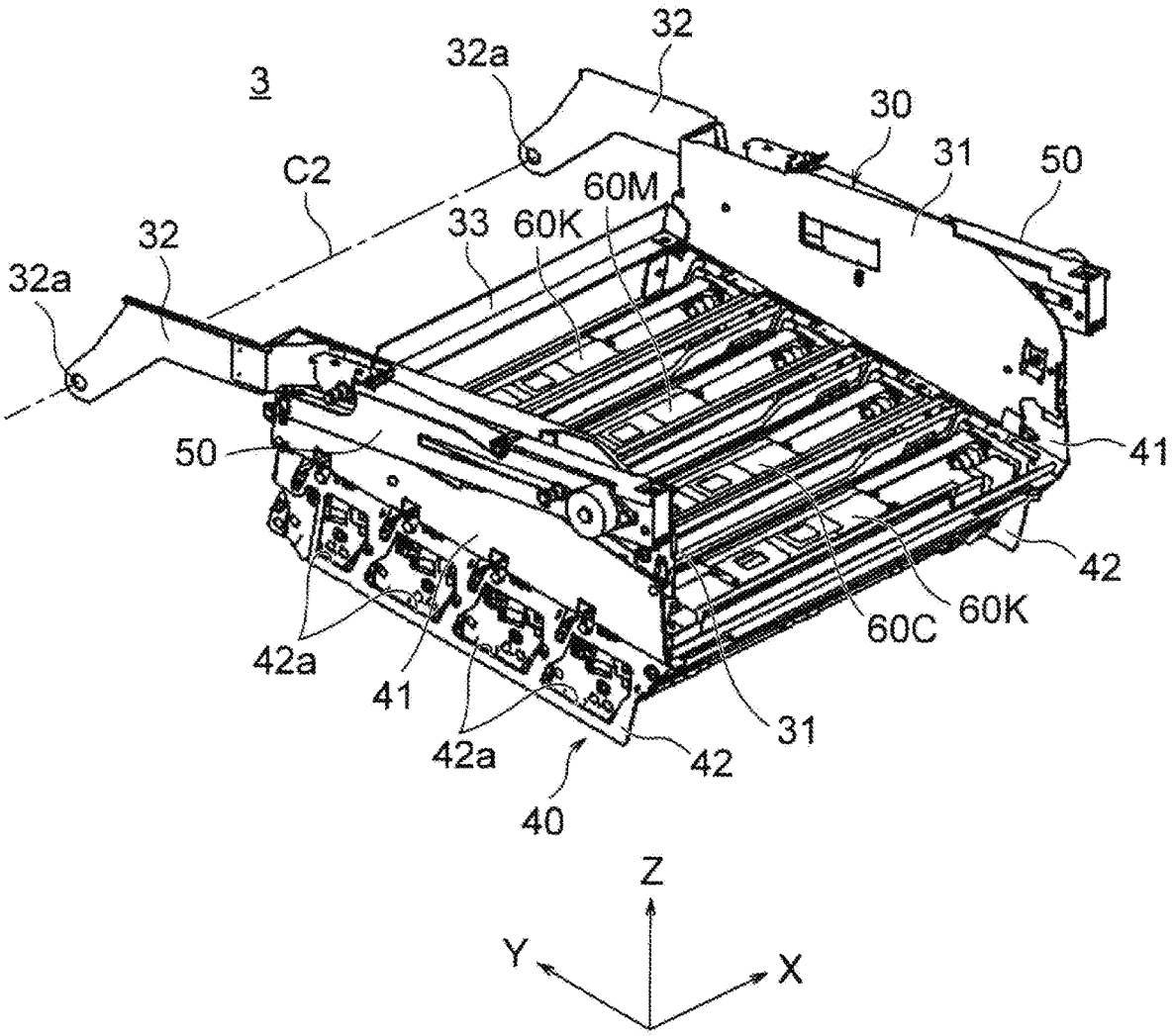
FIG. 5 is a diagram illustrating a perspective view of the basket unit according to an embodiment.

Next, the basket unit 3 is explained. FIG. 5 is a diagram illustrating a perspective view of the basket unit 3. The basket unit 3 includes the basket 40 (the movable unit) that holds the process units 60K, 60C, 60M, and 60Y and a rotatable frame 30 (a basket holding member) that holds the basket 40.

Figure 6:
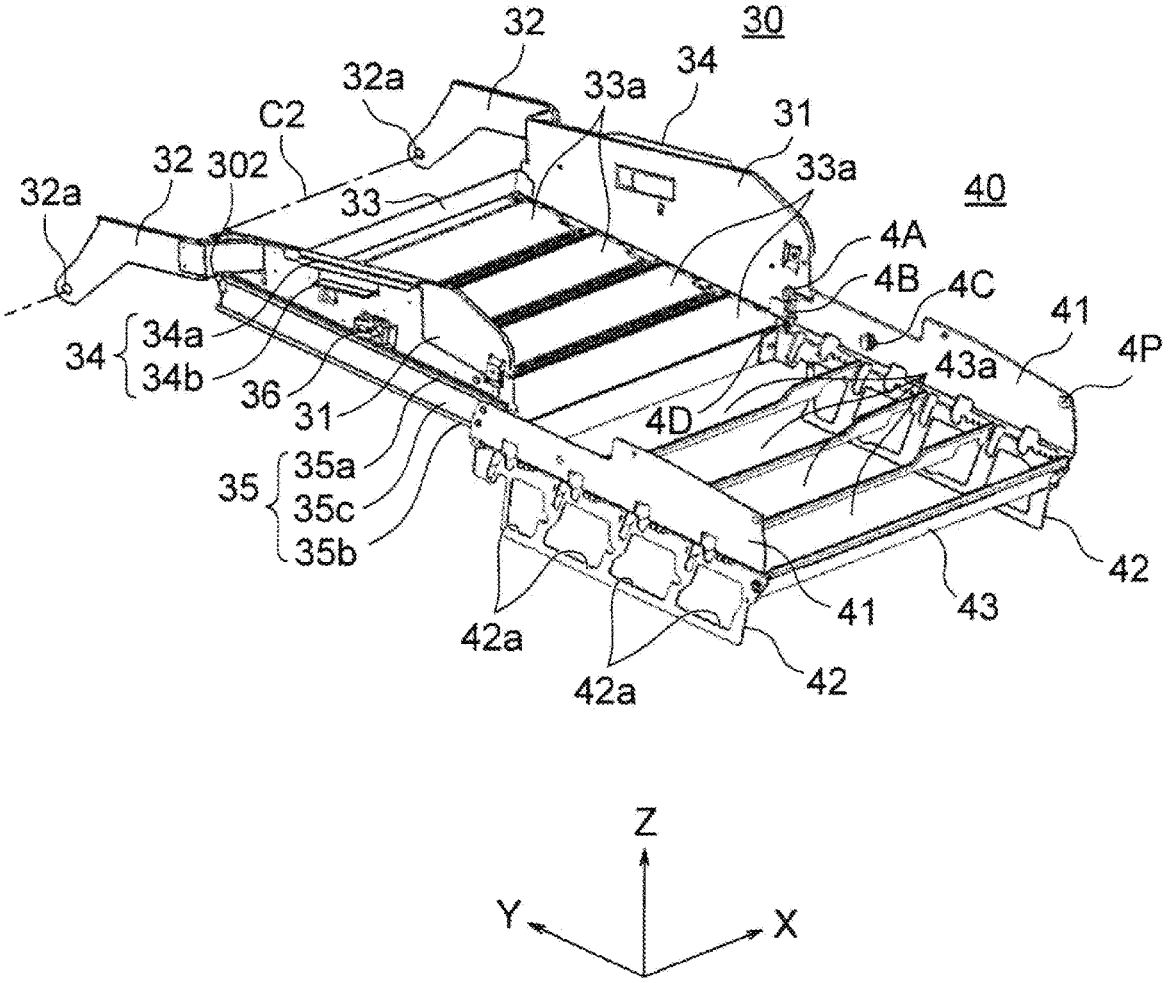
FIG. 6 is a diagram illustrating a perspective view of a state where a basket is pulled out from a rotatable frame of the basket unit according to an embodiment.

FIG. 6 is a diagram illustrating a perspective view of the state where the basket 40 is pulled out from the rotatable frame 30 of the basket unit 3. Strictly speaking, the direction of pulling the basket 40 from the rotatable frame 30 is slightly inclined with respect to the −Y direction, but the following description is made as the direction of pulling the basket 40 from the rotatable frame 30 is the −Y direction (front direction).

The rotatable frame 30 includes a pair of side plates 31 facing each other in the X direction, a rotation arm 32 provided on each of the side plates 31, and a support portion 33 connecting the side plates 31 to each other.

Each of the side plates 31 is a plate-shaped member having a plate surface parallel to the Y-Z plane. The rotation arm 32 extends from the side plate 31 in the +Y direction. The rotation arm 32 includes a hole 32*a* engaging with a support shaft that defines the rotation axis C2 of the top cover unit 20. As a result, the rotation arm 32 can rotate about the same rotation axis C2 as that of the top cover unit 20.

The support portion 33 is formed with four openings 33*a* accommodating the process units 60K, 60C, 60M, and 60Y. The four openings 33*a* are arranged in the Y direction.

A rail guide 34 and a slide rail 35 are provided on an outer surface, in the X direction, of each of the pair of side plates 31. The rail guide 34 is provided at an upper portion of each side plate 31 and the slide rail 35 is provided at a lower portion of each side plate 31.

The slide rail 35 is formed of a sheet metal, for example, and includes an upper rail portion 35*a* and a lower rail portion 35*b* parallel to each other and a support plate 35*c* formed between the upper rail portion 35*a* and the lower rail portion 35*b*. The support plate 35*c* includes a plate surface parallel to the Y-Z plane and is fixed to the side plates 31. The upper rail portion 35*a* extends along the upper end of the support plate 35*c* and the lower rail portion extends along the lower end of the support plate 35*c*. Rotatable members 4A, 4B, 4C and 4D (described later) of the basket 40 are engaged with the slide rail 35.

The rail guide 34 is formed of a sheet metal, for example, and includes an upper guide portion 34*a* and a lower guide portion 34*b* parallel to each other, wherein the length of the lower guide portion 34*b* is shorter than that of the upper guide portion 34*a*. A rotatable member 54 of a stay mechanism 50 (see FIGS. 12A and 12B) is engaged with the rail guide 34.

Between the rail guide 34 and the slide rail 35 of each side plate 31, a stopper 36 is provided. The stopper 36 is in contact with the stay mechanism 50 in a state (see FIG. 14) where the basket 40 is pulled out of the rotatable frame 30 in the −Y direction. Therefore, in the state where the basket 40 is pulled out of the rotatable frame 30, the top cover unit 20 is prevented from being closed.

The basket 40 includes a pair of side plates 41 facing each other in the X direction, a frame portion 42 attached to the lower side of each side plate 41, and a support portion 43 interconnecting the pair of side plates 41.

Each of the pair of side plates 41 is a plate-shaped member having a plate surface parallel to the Y-Z plane, and is located outside the side plate 31 of the rotatable frame 30 in the X direction.

The frame portion 42 attached to the side plate 41 is formed with four openings 42*a* for holding X-side end portions of the process units 60K, 60C, 60M, and 60Y, respectively.

The support portion 43 is formed with four openings 43*a* for accommodating the process units 60K, 60C, 60M and 60Y. The openings 43*a* of the support portion 43 of the basket 40 and the openings 33*a* of the support portion 33 of the rotatable frame 30 are formed at positions overlapping with each other.

In this example, the arrangement pitch of the process units 60K, 60C, 60M and 60Y is 58 mm. Therefore, the arrangement pitch of the openings 43*a* of the basket 40 is also 58 mm.

Each of the pair of side plates 41 of the basket 40 is provided with rotatable members 4A, 4B, 4C, and 4D that are to be engaged with the slide rails 35 of the rotatable frame 30. The rotatable members 4A, 4B, 4C, and 4D are arranged on an inner surface, in the X direction, of each side plate 41.

Figure 7:
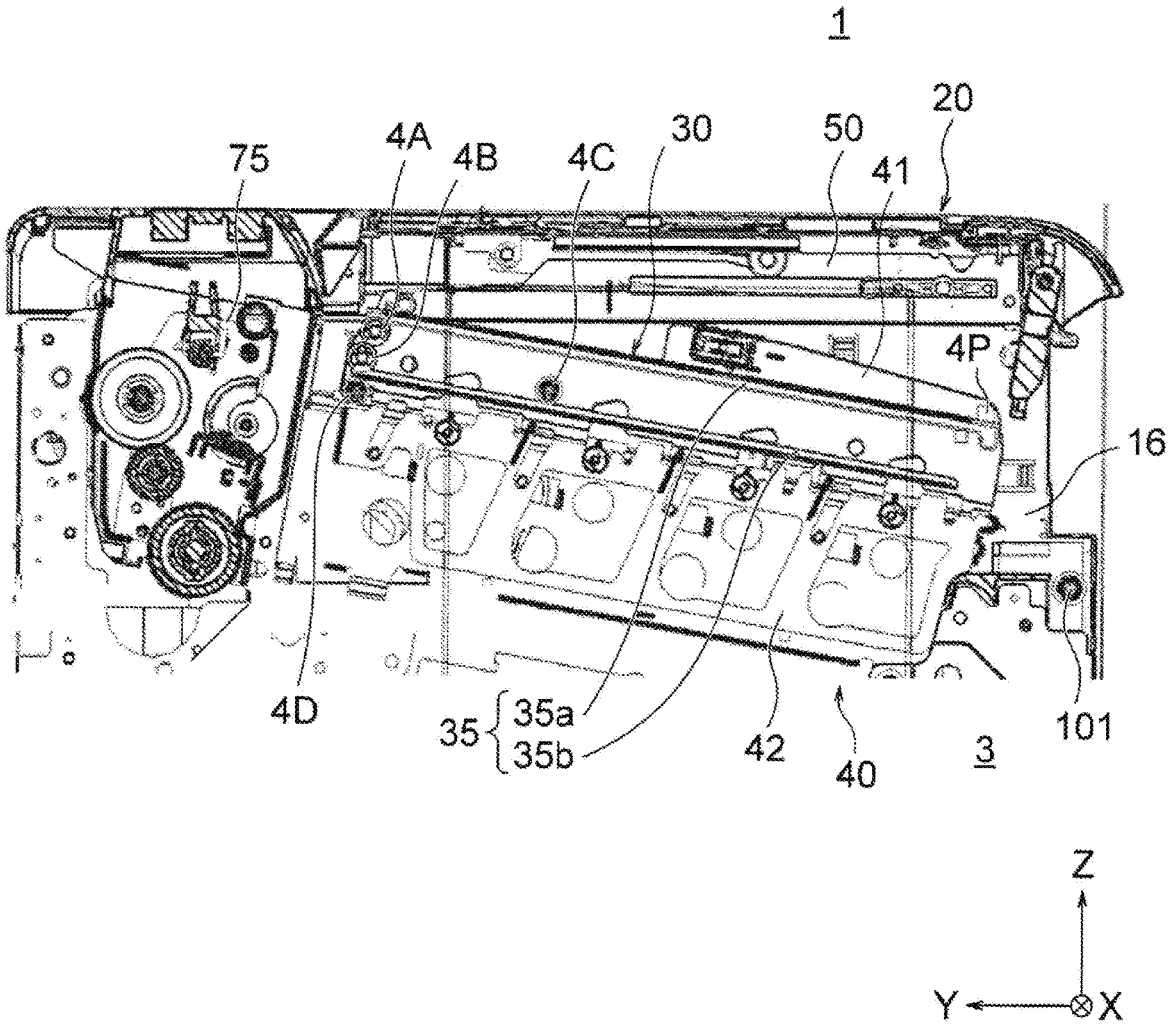
FIG. 7 is a diagram illustrating a cross sectional view of a part of the image formation apparatus including the basket unit.

FIG. 7 is a diagram illustrating a side cross sectional view illustrating a relationship between the basket 40 and the slide rail 35 of the image formation apparatus 1. Note that, in FIG. 7, only the upper rail portion 35*a* and the lower rail portion 35*b* of the slide rail 35 are illustrated in the rotatable frame 30. In FIG. 7, the basket 40 is housed in the housing 11 of the image formation apparatus 1 (that is, in the accommodation position).

The rotatable members 4A, 4B, and 4D are provided in the vicinity of the end portion in the +Y direction (the rear end portion) of the basket 40. The rotatable member 4A serving as a third rotatable member is in contact with the lower surface (the surface on the −Z side) of the upper rail portion 35*a* of the slide rail 35. The rotatable member 4B serving as a fourth rotatable member is in contact with the upper surface (the surface on the +Z side) of the lower rail portion 35*b* of the slide rail 35.

That is, the rotatable members 4A and 4B are respectively in contact with the upper rail portion 35*a* and the lower rail portion 35*b* of the slide rail 35 from the inner side.

The rotatable member 4D as a rotation restriction member is in contact with the lower surface (the surface on the −Z side) of the lower rail portion 35*b* of the slide rail 35. That is, the rotatable member 4D is in contact with the lower rail portion 35*b* of the slide rail 35 from the outer side.

The rotatable members 4A, 4B, and 4D are arranged between, in the Y direction, the fixation device 75 and the opening 43*a* (FIG. 6) of the basket 40 in which the process units 60Y are mounted. That is, the rotatable members 4A, 4B, and 4D are arranged at positions that do not hinder the attachment and detachment of the process unit 60Y.

It may be preferable that the Y-direction positions (more specifically, the positions in the longitudinal direction of the slide rail 35) of the rotatable members 4A, 4B, and 4D be substantially the same.

A rotatable member 4C serving as a second rotatable member is provided at a position separated from the rotatable members 4A, 4B, and 4D by a predetermined distance in the −Y direction (the pull-out direction). The rotatable member 4C is in contact with the upper surface (the +Z side surface) of the lower rail portion 35*b* of the slide rail 35.

The rotatable member 4C is arranged between, in the Y direction, the two openings 43*a* (FIG. 6) of the basket 40 in which the process units 60Y and 60M are mounted. That is, the rotatable member 4C is arranged at a position that does not hinder the attachment and detachment of the process units 60Y and 60M.

Figure 8:
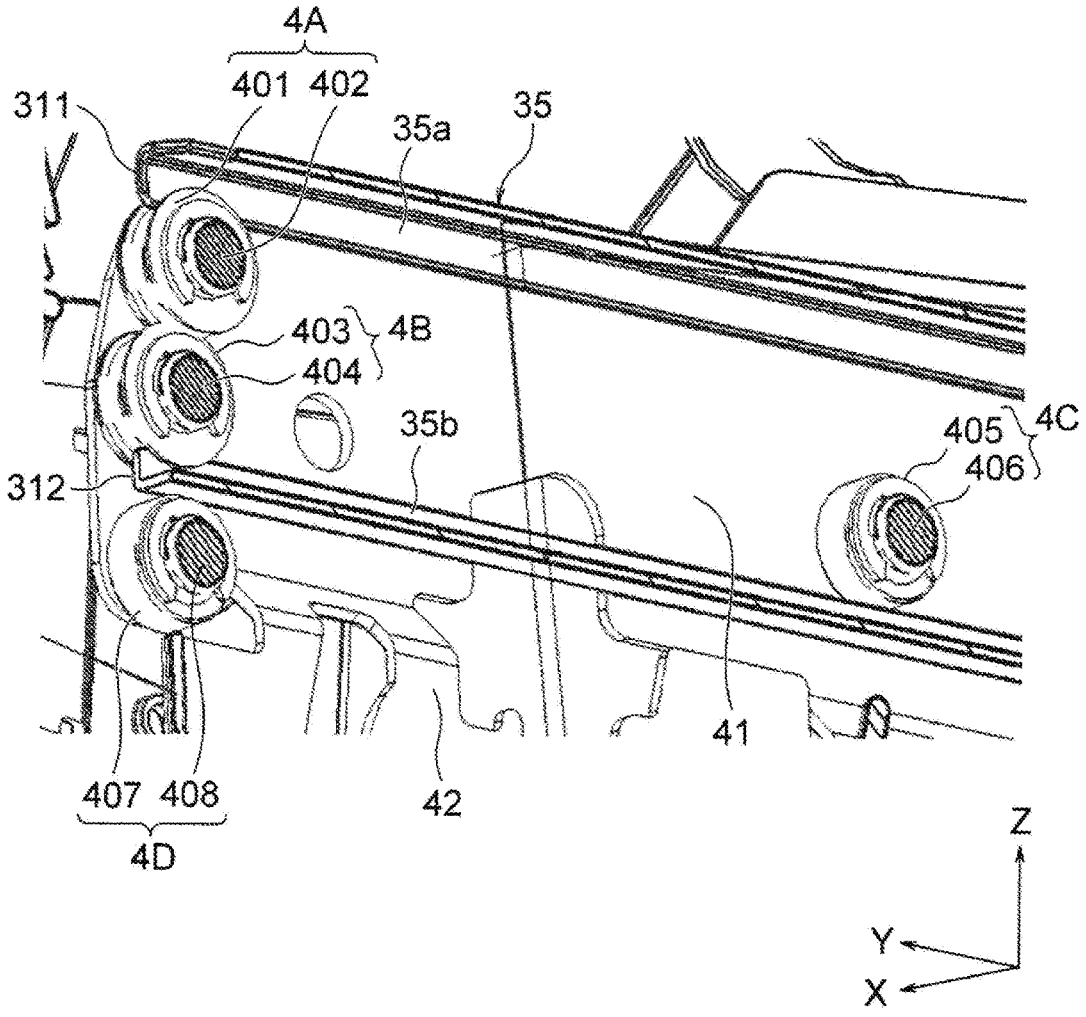
FIG. 8 is a diagram illustrating a perspective view of a part of the image formation apparatus in the vicinity of a slide rail and rotatable members according to an embodiment.

FIG. 8 is a perspective view illustrating a relationship between the rotatable members 4A, 4B, 4C, and 4D of the basket 40 and the upper rail portion 35*a* and the lower rail portion 35*b* of the slide rail 35.

The rotatable member 4A (third rotatable member) includes a shaft part 401 (or a retainer) fixed to the side plate 41 and a roller 402 or a column rotatably attached to (rotatably held by) the shaft part 401. The shaft part 401 is made of metal, for example, and the axial direction of the shaft part 401 is the X direction. The roller 402 is attached to the shaft part 401 with an E-ring or the like. An outer circumferential surface of the roller 402 includes a groove extending in the circumferential direction.

The rotatable member 4B (fourth rotatable member) includes a shaft part 403 (or a retainer) fixed to the side plate 41 and a roller 404 or a column rotatably attached to (rotatably held by) the shaft part 403. The shaft part 403 is made of metal, for example, and the axial direction of the shaft part 403 is the X direction. The roller 404 is attached to the shaft part 403 with an E-ring or the like. An outer circumferential surface of the roller 404 includes a groove extending in the circumferential direction.

The rotatable member 4C (second rotatable member) includes a shaft part 405 (or a retainer) fixed to the side plate 41 and a roller 406 or a column rotatably attached to (rotatably held by) the shaft part 405. The shaft part 405 is made of metal, for example, and the axial direction of the shaft part is the X direction. The roller 406 is attached to the shaft part 405 with an E-ring or the like. The roller 406 has a cylindrical shape.

The rotatable member 4D (rotation restriction member) includes a shaft part 407 (or a retainer) fixed to the side plate 41 and a roller 408 or a column rotatably attached to (rotatably held by) the shaft part 407. The shaft part 407 is made of metal, for example, and the axial direction of the shaft part is the X direction. The roller 408 is attached to the shaft part 407 with an E-ring or the like. The roller 408 has a cylindrical shape.

A plate portion 311, parallel to the X-Z plane, of the upper rail portion 35*a* of the slide rail 35 is engaged with the groove of the roller 402 of the rotatable member 4A. As a result, displacement of the upper rail portion 35*a* in the X direction is prevented.

A plate portion 312, parallel to the X-Z plane, of the lower rail portion 35*b* of the slide rail 35 is engaged with the groove of the roller 404 of the rotatable member 4B. This prevents displacement of the lower rail portion 35*b* in the X direction.

The outer peripheral surface of the rotatable member 4C is in contact with the upper end surface of the lower rail portion 35*b* of the slide rail 35. The outer peripheral surface of the rotatable member 4D is in contact with the lower end surface of the lower rail portion 35*b* of the slide rail 35.

Note that a member that does not rotate may be used instead of the rotatable member 4D. However, the use of the rotatable member 4D is advantageous in that the movement of the basket 40 becomes smooth.

Returning to FIG. 7, a post 4P serving as a contact portion is formed at the distal end portion (front end portion) in the −Y direction of each side plate 41 of the basket 40. The post 4P contacts the upper end surface of the upper rail portion 35*a* of the slide rail 35. The post 4P is, for example, a convex portion provided on the side plate 41, but may be a rotatable member.

Figure 9:
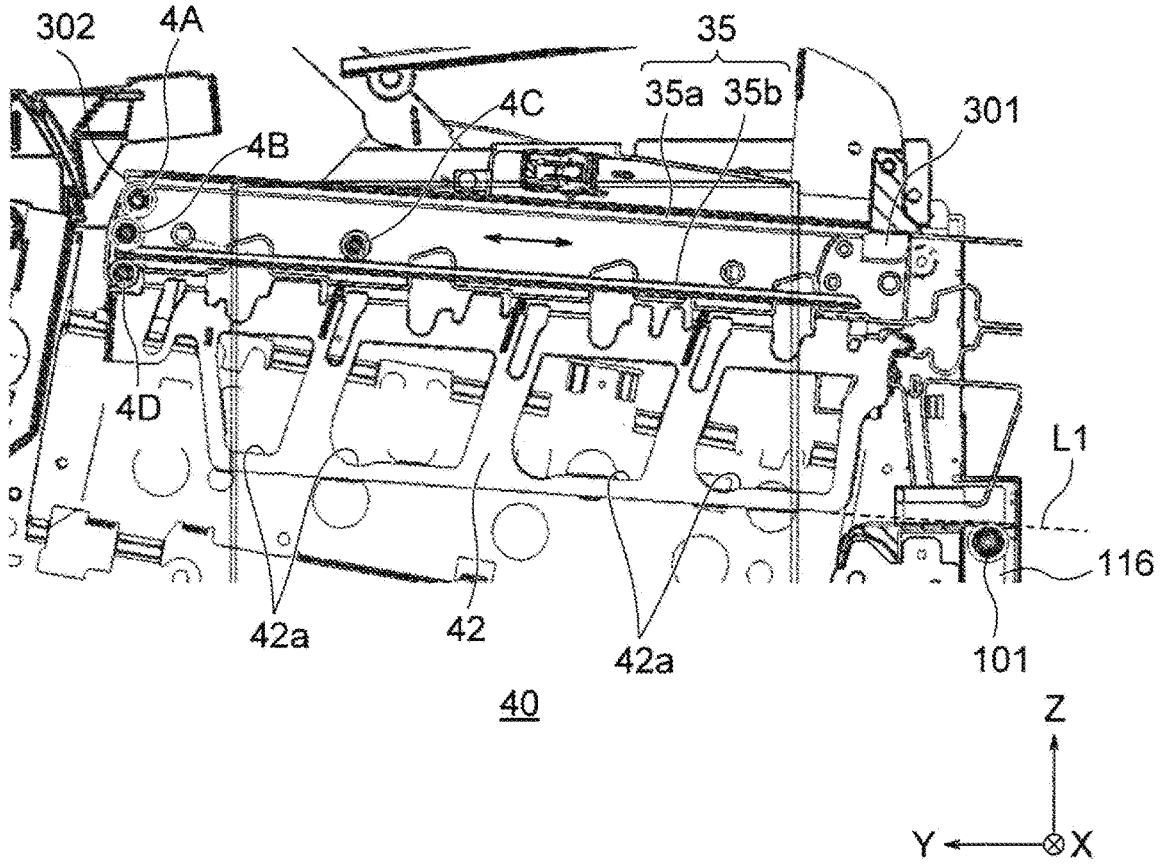
FIG. 9 is a diagram illustrating a side view of a part of the image formation apparatus in the vicinity of the slide rail and the rotatable members according to an embodiment.

As will be described later, when the top cover unit 20 is decoupled from the basket unit 3 and is rotated, the basket unit 3 rotates by an angle (for example, 6 degrees) smaller than the rotation angle (first angle) of the top cover unit 20 by the action of the stay mechanism 50. FIG. 9 illustrates a state in which the basket unit 3 is rotated by that angle.

The housing 11 is provided with a rotatable member 101 serving as a first rotatable member at a position where the basket unit 3 can be engaged with the lower end portion of the basket 40 in the state where the basket unit 3 is rotated by the angle. More specifically, the rotatable member 101 is arranged at the position where the outer circumference of the rotatable member 101 is in contact with the extension line L1 of the lower end portion of the frame portion 42 of the basket 40.

Figure 10:
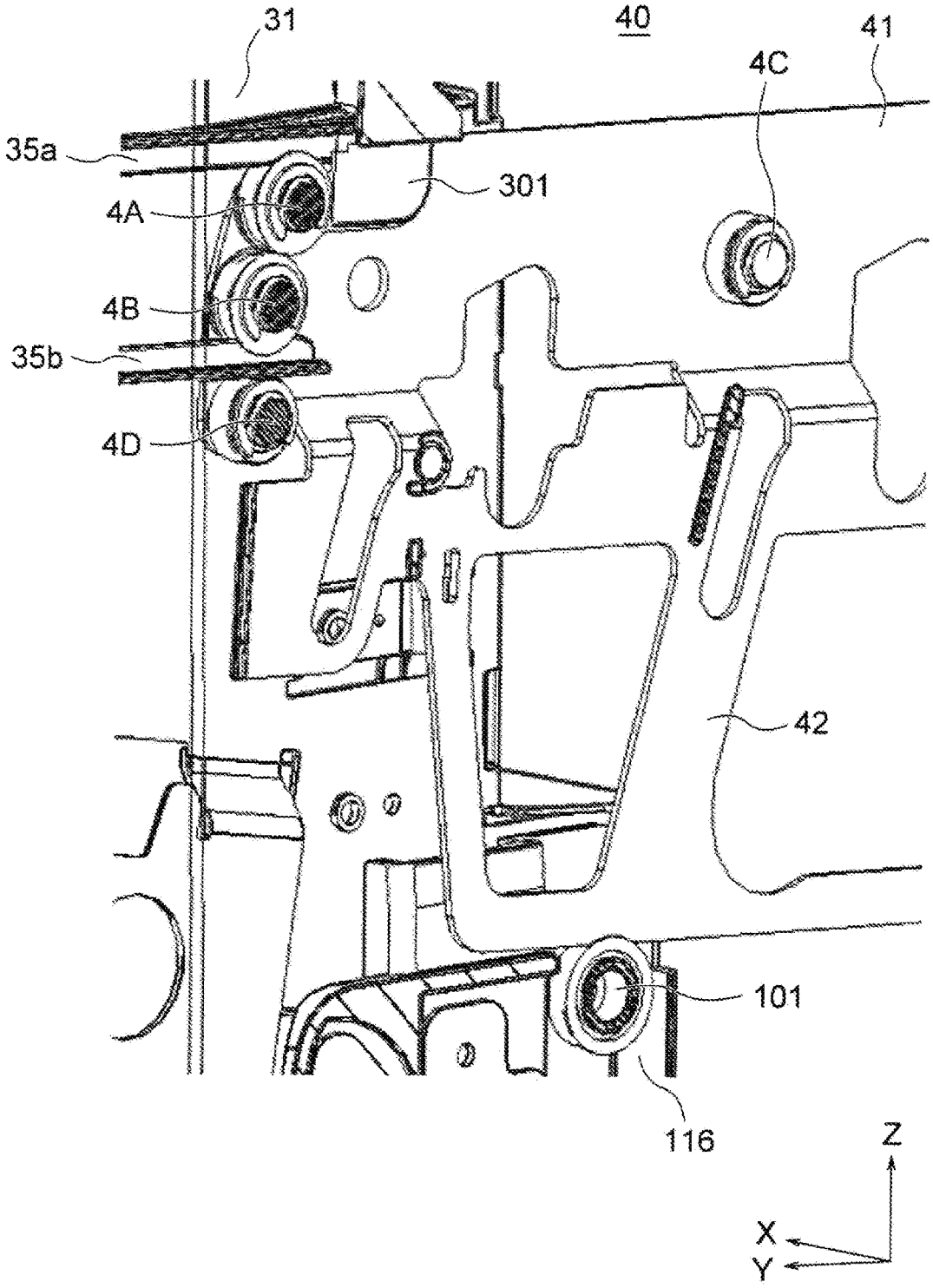
FIG. 10 is a diagram illustrating a perspective view of a part of the image formation apparatus in the vicinity of the slide rail and the rotatable members according to an embodiment.

FIG. 10 is a diagram illustrating a positional relationship between the basket 40 that is pulled out in the −Y direction from the position thereof illustrated in FIG. 9 and the rotatable member 101 of the housing 11. When the basket 40 is pulled out by a predetermined distance in the −Y direction, the rotatable member 101 provided at the housing 11 supports the lower end portion of the basket 40 (more specifically, the lower end portion of the frame portion 42).

The rotatable member 101 is provided on each of inner wall portions 116 on both sides of the housing 11 in the X direction. The rotatable member 101 includes a shaft part (or a retainer) fixed to the inner wall portion 116 and a roller or a column rotatably attached to (rotatably held by) the shaft part.

Note that the rotatable member 101 may be provided with a groove as in the rotatable members 4A and 4B described above. According to this structure, the rotatable member 101 can position the basket 40 in the X direction.

As illustrated in FIG. 9, each side plate 31 of the rotatable frame 30 is provided with a stopper 301 serving as a first stopper that defines a movement limit position of the basket 40 when the basket 40 is pulled out. The stopper 301 is arranged at a position where the stopper 301 comes into contact with the rotatable member 4A when the basket 40 is pulled out in the −Y direction.

Figure 11A:
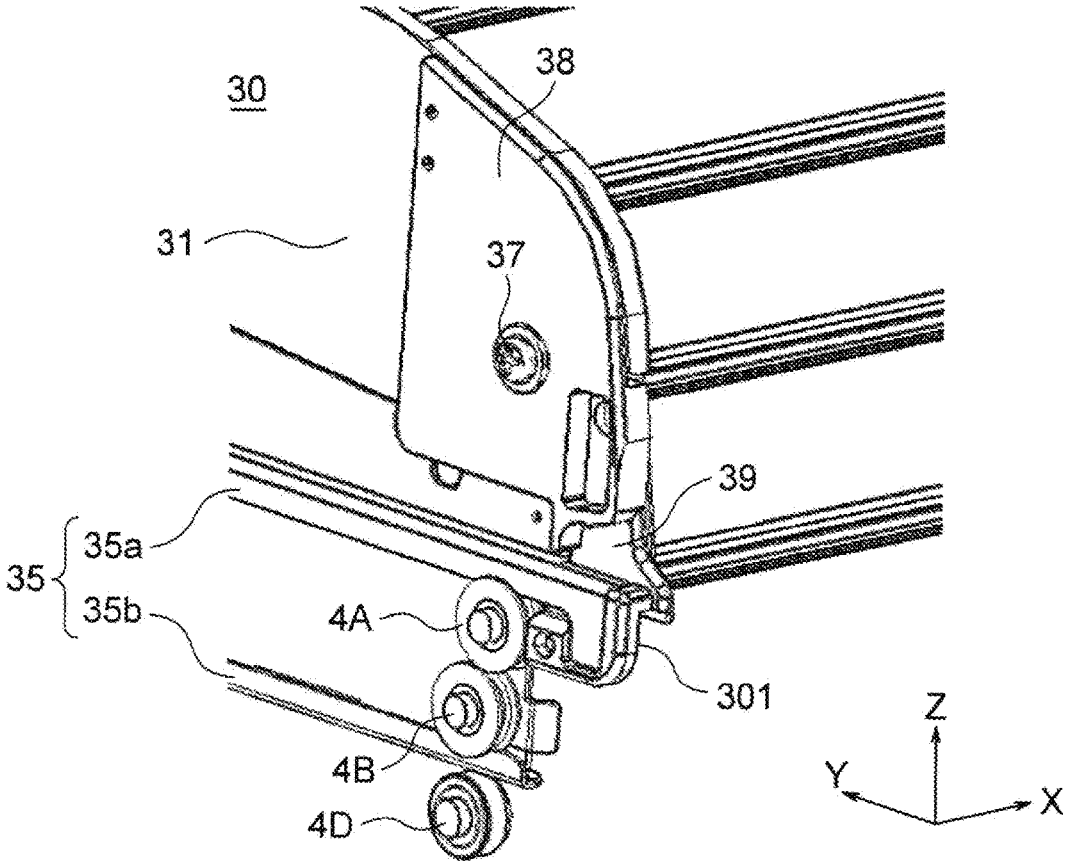
FIGS. 11A and 11B are diagrams illustrating perspective views of an attachment structure of a stopper according to an embodiment.
Figure 11B:
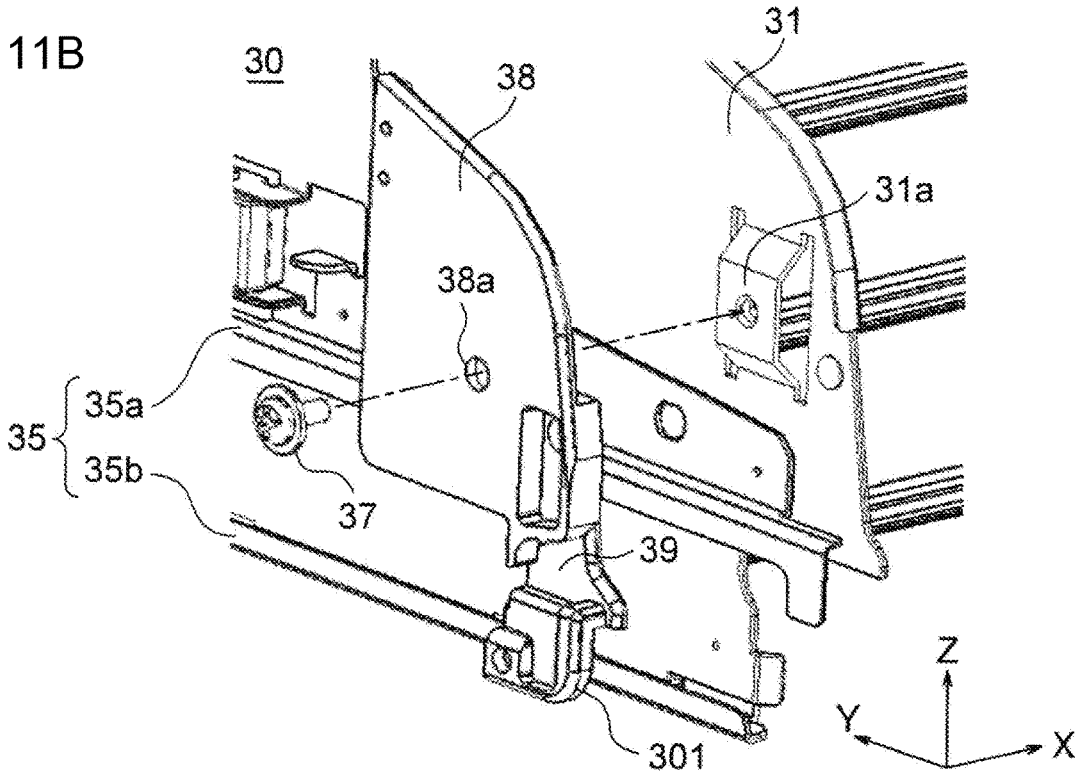

FIGS. 11A and 11B are a perspective view and an exploded perspective view of an attachment structure of the stopper 301. As illustrated in FIG. 11A, a mount plate 38 for the stopper 301 is fixed to the −Y side end (front end) of each side plate 31 of the rotatable frame 30.

As illustrated in FIG. 11B, the mount plate 38 includes a through hole 38*a*, and is fixed to a pedestal portion 31*a* of the side plate 31 with a screw 37 penetrating the through hole 38*a*. An arm 39 is attached to the lower side (−Z side) of the mount plate 38 so as to project into the movement path of the rotatable member 4A when the basket 40 is pulled out. The arm 39 is provided with the stopper 301.

As illustrated in FIG. 6, a stopper 302 serving as a second stopper is provided at the +Y side end (rear end) of each slide rail 35. The stopper 302 comes in contact with the rotatable member 4A when the basket 40 is pushed in the +Y direction. The stopper 302 is, for example, a convex portion formed on the support plate 35*c* of the slide rail 35.

Note that the stoppers 301 and 302 are not limited to the configuration described here, and may be any as long as they come in contact with the rotatable member 4A to define the movement range of the basket 40 when the basket 40 moves in the −Y direction and the +Y direction.

Next, the functions of the rotatable members 4A, 4B, 4C, and 4D and the post 4P of the basket 40, the rotatable member 101 of the housing 11, and the stoppers 301 and 302 of the rotatable frame 30 are described with reference to FIG. 9 (see also FIGS. 15A to 15E).

The rotatable member 4A regulates the position of the basket 40 in the +Z direction. More specifically, when the basket 40 tries to move in the +Z direction, the rotatable member 4A contacts the lower surface of the upper rail portion 35*a* of the slide rail 35.

Further, the rotatable member 4A comes in contact with the stopper 301 when the basket 40 is pulled out in the −Y direction, and comes in contact with the stopper 302 when the basket 40 is pushed in the +Y direction. As a result, the movement range of the basket 40 in the Y direction is defined.

The rotatable member 4B regulates the position of the basket 40 in the −Z direction. More specifically, when the basket 40 tries to move in the −Z direction, the rotatable member 4B contacts the upper surface of the lower rail portion 35*b* of the slide rail 35. In other words, the rotatable member 4B supports (guides) the basket 40.

Further, the rotatable members 4A and 4B suppress the positional deviation between the basket 40 and the slide rail 35 in the X direction by the grooves formed in the rollers 402 and 404.

The rotatable member 4C regulates the position of the basket 40 in the −Z direction. More specifically, when the basket 40 tries to move in the −Z direction, the rotatable member 4C contacts the upper surface of the lower rail portion 35*b* of the slide rail 35. In other words, the rotatable member 4C supports (guides) the basket 40.

However, when the basket 40 is pulled out in the −Y direction by a predetermined distance (for example, 165 mm), the slide rail 35 is disengaged from the rotatable member 4C, and the basket 40 is supported by the rotatable member 101 as described later. Therefore, the rotatable member 4C supports the basket 40 until the slide rail 35 comes off the rotatable member 4C (that is, until the basket 40 is supported by the rotatable member 101).

The rotatable member 4D regulates the position of the basket 40 in the +Z direction. More specifically, when the basket 40 tries to move in the +Z direction, the rotatable member 4D contacts the lower surface of the lower rail portion 35*b* of the slide rail 35. Further, the rotatable member 4D restricts the basket 40 from rotating upward about the rotatable member 4A in the state where the basket 40 is pulled out in the −Y direction.

The rotatable member 101 contacts the lower end of the frame portion 42 of the basket 40 and supports (guides) the basket 40 in the state where the basket 40 is pulled out in the −Y direction.

The post 4P (FIG. 7) regulates the position of the basket 40 in the −Z direction when the basket 40 is accommodated in the housing 11. More specifically, when the basket 40 tries to move in the −Z direction in the state where the basket 40 is accommodated in the housing 11, the post 4P contacts the upper surface of the upper rail portion 35*a* of the slide rail 35.

When the basket 40 is pulled out in the −Y direction, the stopper 301 comes in contact with the rotatable member 4A. When the basket 40 is pushed in the +Y direction, the stopper 302 comes in contact with the rotatable member 4A. That is, the stoppers 301 and 302 define the movement range of the basket 40 in the Y direction (pull-out direction and pushing direction).

Stay Mechanism

Next, the stay mechanism 50 is described. The stay mechanism 50 is a mechanism for rotating the basket unit 3 by the rotation angle (for example, about 6 degrees) smaller than the rotation angle (for example, about 31 degrees) of the top cover unit 20 when the top cover unit 20 is decoupled from the basket unit 3 and opened. The stay mechanism 50 is provided at each of both ends in the X direction of the housing 11 as illustrated in FIG. 3.

Figure 12A:
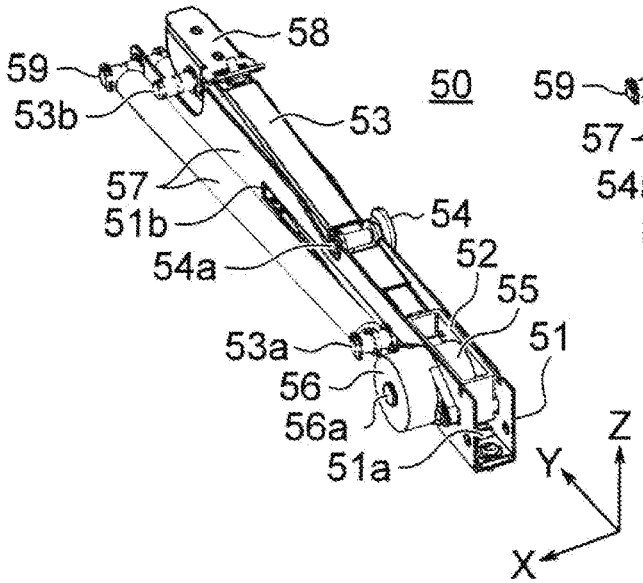
FIGS. 12A and 12B are diagram illustrating perspective views of a stay mechanism according to an embodiment.
Figure 12B:
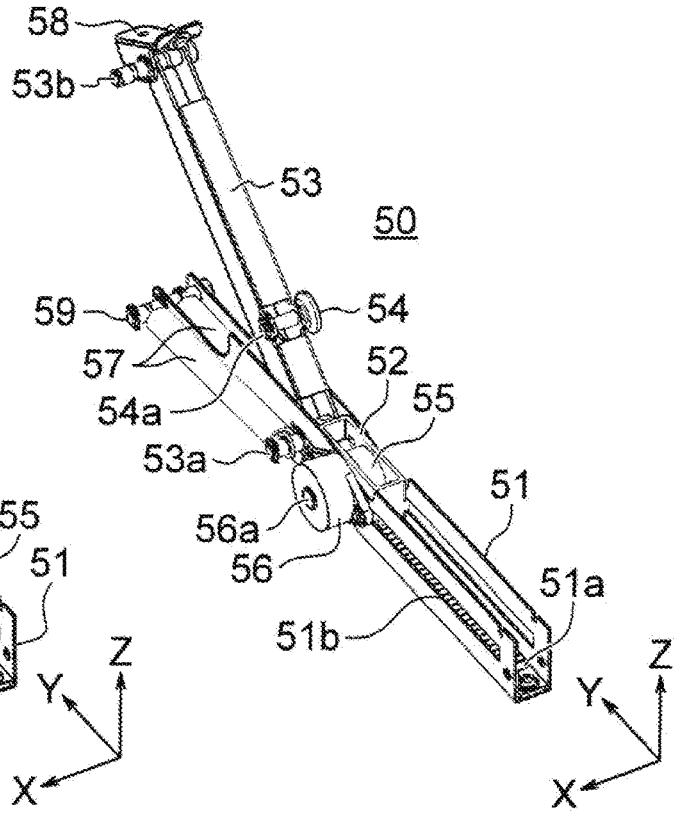
Figure 13A:
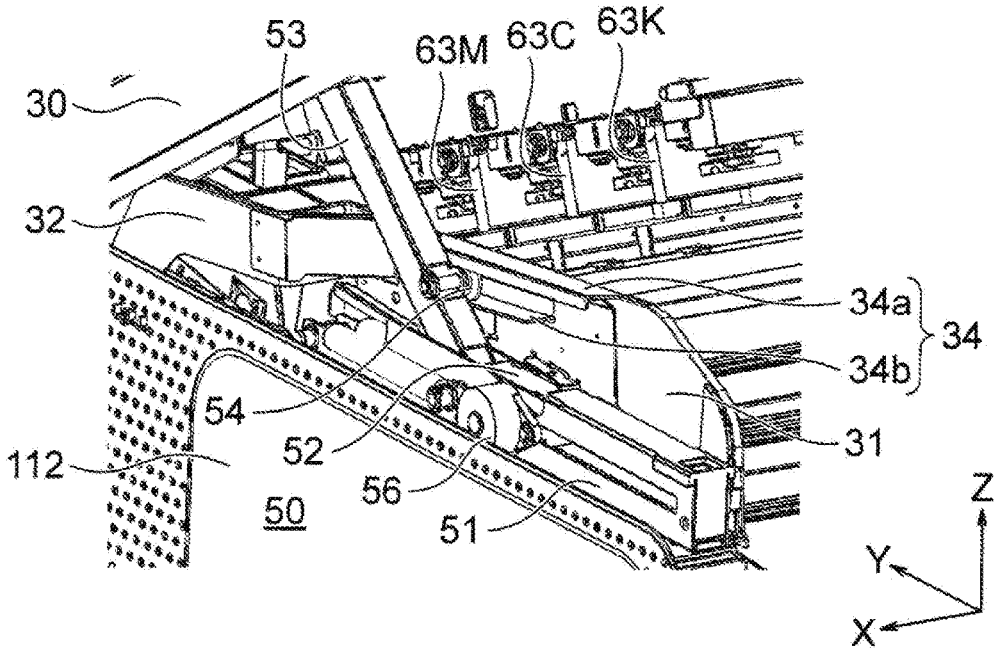
FIGS. 13A and 13B are diagram illustrating perspective views illustrating an operation of the stay mechanism according to an embodiment.
Figure 13B:
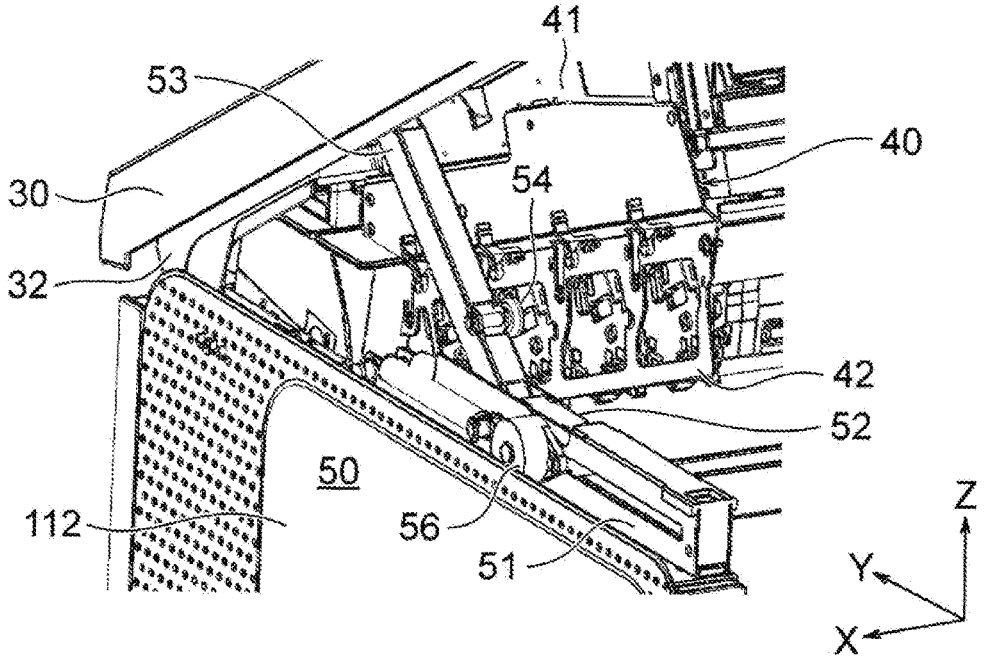

FIGS. 12A and 12B are perspective views illustrating of the structure of the stay mechanism 50. FIGS. 13A and 13B are perspective views illustrating the operation of the stay mechanism 50. As illustrated in FIG. 12A, the stay mechanism 50 includes a stay frame 51, a slide frame 52, a stay 53, a rotatable member 54, a gear 55, a damper 56, a spring 57, and a connecting plate 58.

The stay frame 51 extends in the Y direction and is attached to the upper end of the side wall 112 (FIG. 3) of the housing 11. The stay frame 51 has a U-shape in a plane orthogonal to the Y direction, and a rack 51*a* is provided on the bottom of the stay frame 51. The slide frame 52 is a substantially box-shaped member that opens in the +Z direction. The slide frame 52 is arranged inside the stay frame 51 so as to be movable in the stay frame 51 in the Y direction.

One end of the stay 53 is connected to the slide frame 52 via a rotational shaft 53*a* extending in the X direction, and the other end of the stay 53 is connected to the connecting plate 58 via a rotational shaft 53*b* extending in the X direction. The connecting plate 58 is fixed to the top cover unit 20. As a result, the inclination state of the stay 53 changes in association with the opening and closing movements of the top cover unit 20.

When the top cover unit 20 is closed, the stay 53 is pushed down in the −Z direction by the top cover unit 20. Accordingly, the stay 53 moves in the −Y direction, while the connecting portion of the stay 53 with the slide frame 52 rotates about the rotational shaft 53*a* and the connecting portion of the stay 53 with the connecting plate 58 rotates about the rotational shaft 53*b*. At this time, the slide frame 52 is pushed by the stay 53 and moves in the −Y direction. As a result, the stay 53 collapses about the rotational shaft 53*a* as a fulcrum and is housed inside the stay frame 51 as illustrated in FIG. 12A.

When the top cover unit 20 is opened, the stay 53 is lifted by the top cover unit 20 in the +Z direction. Accordingly, the stay 53 moves in the +Y direction, while the connecting portion of the stay 53 with the slide frame 52 rotates about the rotational shaft 53*a* and the connecting portion of the stay 53 with the connecting plate 58 rotates about the rotational shaft 53*b*. At this time, the slide frame 52 is pulled by the stay 53 and moves in the +Y direction. As a result, the stay 53 rise up about the rotational shaft 53*a* as the fulcrum, and the stay 53 is separated away from the inside of the stay frame 51 as illustrated in FIG. 12B.

The rotatable member 54 is provided on the inner surface of the stay 53 in the X direction, and is rotatable about the rotational shaft 54*a* extending in the X direction. The rotatable member 54 can be engaged with the rail guide 34 (FIG. 13A) of the rotatable frame 30, and can move along the rail guide 34 in conjunction with the rotation of the top cover unit 20.

When the top cover unit 20 is opened in the state where the top cover unit 20 and the basket unit 3 are decoupled from each other as illustrated in FIG. 13A, the stay 53 rises as the top cover unit 20 rotates, so that the rotatable member 54 is moved upward (in the +Z direction) and reaches the height of the rail guide 34 of the rotatable frame 30. Thus, the rotatable member 54 is engaged with the rail guide 34.

Due to the engagement between the rotatable member 54 and the rail guide 34, the rotatable frame 30 (and the basket 40 held by the rotatable frame 30) is rotated along with the rotation of the top cover unit 20 by a rotation angle smaller than the rotation angle of the top cover unit 20.

On the other hand, when both the top cover unit 20 and the rotatable frame 30 are opened in the state where they are coupled with each other as illustrated in FIG. 13B, the rotatable member 54 rises as the top cover unit 20 rotates, so that the rotatable member 54 is moved upward as the top cover unit 20 rotates. At this time, the rail guide 34 is located above the rotatable member 54 because the rotatable frame 30 is opened. Thus, the rotatable member 54 is not engaged with the rail guide 34.

A gear 55 is accommodated in the slide frame 52. A damper 56 having a rotation shaft 56*a* in the X direction is attached to an outer surface of the slide frame 52 in the X direction. The damper 56 is arranged outside the stay frame 51, but is fixed to the slide frame 52 via an elongate hole 51*b* formed in the stay frame 51.

The gear 55 is rotatable around the rotation shaft 56*a* of the damper 56. The gear 55 meshes with the rack 51*a* of the stay frame 51 and is moved in the Y direction while rotating in mesh with the rack 51*a* in conjunction with the movement of the slide frame 52 caused by the change in the inclination angle of the stay 53.

The damper 56 applies a load to the rotation of the gear 55 regardless of whether the slide frame 52 moves in the −Y direction or the +Y direction. As a result, the load is applied to the movement of the slide frame 52, and a sudden change in the inclination angle of the stay 53 is suppressed. This prevents the top cover unit 20 from suddenly being opened or suddenly being closed.

The slide frame 52 is biased in the +Y direction by a spring 57 provided between the rotation shaft 53*a* of the stay 53 and a stopper 59 provided at the rear end of the stay frame 51. As a result, one end of the stay 53 connected to the slide frame 52 is biased in the +Y direction. That is, the spring 57 assists the operation of opening the top cover unit 20. Here, each stay mechanism 50 has two springs 57, but the number of springs 57 is arbitrary in this disclosure.

Operation of Image Formation Apparatus

Next, an image forming operation (a printing operation) by the image formation apparatus 1 is described with reference to FIG. 1. When a controller or a control unit of the image formation apparatus 1 receives a print command and print data from a host device or an external device, the controller starts an image forming operation.

First, the pickup roller 82 picks up the medium P accommodated in the medium tray 81, and the feed roller 83 feeds the medium P into the transport path R1. The retard roller 84 imparts a conveyance resistance to the medium P to prevent double-feeding. The conveyance rollers 85 and 86 rotate and convey the medium P fed in the transport path R1 to the image formation section 10.

In the transfer unit 70, the drive roller 73 rotates to run the transfer belt 72. The transfer belt 72 adsorbs and holds the medium P thereon and conveys the medium P. The medium P passes through the process units 60K, 60C, 60M, and 60Y in this order.

In the process units 60, toner images of respective colors are formed. Specifically, in each of the process units 60, the photosensitive drum 61 rotates, and along with this, the charge roller 62, the development roller 64, and the supply roller 65 also rotate. The charge roller 62 uniformly charges the surface of the photosensitive drum 61. The exposure head 63 exposes the charged surface of the photosensitive drum 61 based on the image data of each color to form an electrostatic latent image on the surface of the photosensitive drum 61.

The toner attached to the development roller 64 is supplied and develops the electrostatic latent image formed on the surface of the photosensitive drum 61, so as to form a toner image on the surface of the photosensitive drum 61. The transfer voltage applied to the transfer roller 71 transfers the toner image on the photosensitive drum 61 to the medium P on the transfer belt 72.

In this way, the toner images of the respective colors formed by the process units 60K, 60C, 60M, and 60Y are sequentially transferred and thus superposed onto the medium P. The medium P onto which the toner images of the respective colors have been transferred is further conveyed by the transfer belt 72 and reaches the fixation device 75.

The fixation device 75 applies heat and pressure to the medium P between the fixation roller 76 and the pressure roller 77, to fix the toner images on the medium P.

The medium P on which the toner images are fixed is conveyed by the discharge rollers 91 and 92 along the discharge path R2, and is discharged to the outside of the image formation apparatus 1. The discharged media P are stacked on the stacker 24*b*. As a result, the image forming operation on the medium P is completed.

In the case of double-sided printing, the medium P having the toner image fixed thereon is temporarily retracted to the retreat path R3 by the switching guide 89, the conveyance rollers 94 and 95, and the switching guide 96, is reversed from the retreat path R3 to the return path R4, and conveyed along the return path R4 by the conveyance rollers 97 to 99. The medium P conveyed through the return path R4 reaches the transport path R1 and then is conveyed to the image formation section 10 again by the conveyance rollers 86. In the image formation section, toner images are formed on the back surface of the medium P.

When a detector such as a remaining amount detection sensor or the like detects that the remaining amount of the toner in any of the process units 60 is low, a spiral conveyer provided in the toner transport path in the top cover unit 20 rotates to supply (replenish) the toner from the corresponding toner cartridge 23 to the process unit 60.

In the image forming operation described above, the first operation lever 21 (see FIG. 3) is in the position (the lock position) where the lock portions 215 are engaged with the openings 115 of the housing 11. Further, the second operation lever 22 is at the position (the coupling position) where the top cover unit 20 and the basket unit 3 are coupled (a position where the shutter opens the toner transport path).

When a jammed medium P needs to be removed from the housing 11 or the transfer unit 70 needs to be replaced, the top cover unit 20 and the basket unit 3 are opened in the state where they are coupled (see FIG. 3). On the other hand, when any one of the process units 60 needs to be replaced, the top cover unit 20 is decoupled from the basket unit 3 and then the top cover unit 20 is opened (see FIG. 4).

In either case, the user first opens the front cover 12. With this, the user can operate the first operation lever 21 and the second operation lever 22 arranged on the front surface of the top cover unit 20.

Opening Operation of Top Cover Unit and Basket Unit

In the operation of opening the top cover unit 20 and the basket unit 3 in the state where the top cover unit 20 and the basket unit 3 are coupled (in the coupled state), the user first operates the first operation lever 21.

When the user pulls the first operation lever 21 in the −Y direction, the lock portions 215 (FIG. 2) of the first operation lever 21 come out of the openings 115 (FIG. 2) of the housing 11, so that the lock of the top cover unit 20 with respect to the housing 11 is released.

At this time, the second operation lever 22 is at the position (coupling position) that couples the top cover unit 20 and the basket unit 3. Thus, the user holds the first operation lever 21 and opens the top cover unit 20, so that the basket unit 3 is also opened together with the cover unit 20.

As a result, both the top cover unit 20 and the basket unit 3 are opened as illustrated in FIG. 3, and the conveyance path for the medium P in the housing 11 is widely exposed. In this state, the jammed medium P can be removed from the inside of the housing 11, or the transfer unit 70 can be replaced.

In the operation of closing the top cover unit 20 and the basket unit 3, the user closes the top cover unit 20 by pushing, for example, the upper surface of the top cover unit 20 in the −Z direction. Since the position of the basket unit 3 in the +Z direction is restricted by the top cover unit 20, the basket unit 3 is closed together with the top cover unit 20.

When the lock portions 215 of the first operation lever 21 reach the openings 115 of the housing 11 in the process of closing the top cover unit 20, the lock portions 215 are engaged with the openings 115 by the bias force of a torsion spring (not illustrated). As a result, the top cover unit 20 is locked with respect to the housing 11. The second operation lever 22 has not moved from the coupling position in the opening/closing operations.

Opening Operation of Top Cover Unit in Decoupled State

On the other hand, in the operation of decoupling the top cover unit 20 from the basket unit 3 and then opening the top cover unit 20 in the decoupled state, the user first operates the second operation lever 22.

When the second operation lever 22 is pulled out in the −Y direction from the coupling, the shutter blocks the toner transport path to each of the process units 60K, 60C, 60M, and 60Y. Also, the top cover unit 20 and the basket unit 3 are decoupled from each other.

In this state, the user pulls the first operation lever 21 in the −Y direction. As a result, the lock portions 215 (FIG. 2) of the first operation lever 21 come out of the openings 115 of the housing 11, and the lock of the top cover unit 20 with respect to the housing 11 is released.

When the user opens the top cover unit 20 while grabbing the first operation lever 21, the top cover unit 20 is opened in the state where the top cover unit 20 and the basket unit 3 are decoupled from each other. By the action of the stay mechanism 50, the basket unit 3 rotates along with the rotation of the top cover unit by the angle $\alpha$ (for example, 6 degrees) smaller than the rotation angle (for example, 31 degrees) of the top cover unit 20.

Thereby, as illustrated in FIG. 4, the top cover unit 20 can be widely opened. In this state, for example, the exposure head 63 suspended and supported by the top cover unit 20 can be cleaned.

Further, as the top cover unit 20 is opened, the stay mechanism 50 causes the basket unit 3 to rotate about the rotation axis C2 by the angle α (for example, 6 degrees), and thus the height of the lowermost surface of the process units 60K, 60C, 60M, and 60Y held by the basket 40 is higher than that of the handle 701 (see FIG. 4) of the transfer unit 70 and the conveyance rollers 86.

Figure 14:
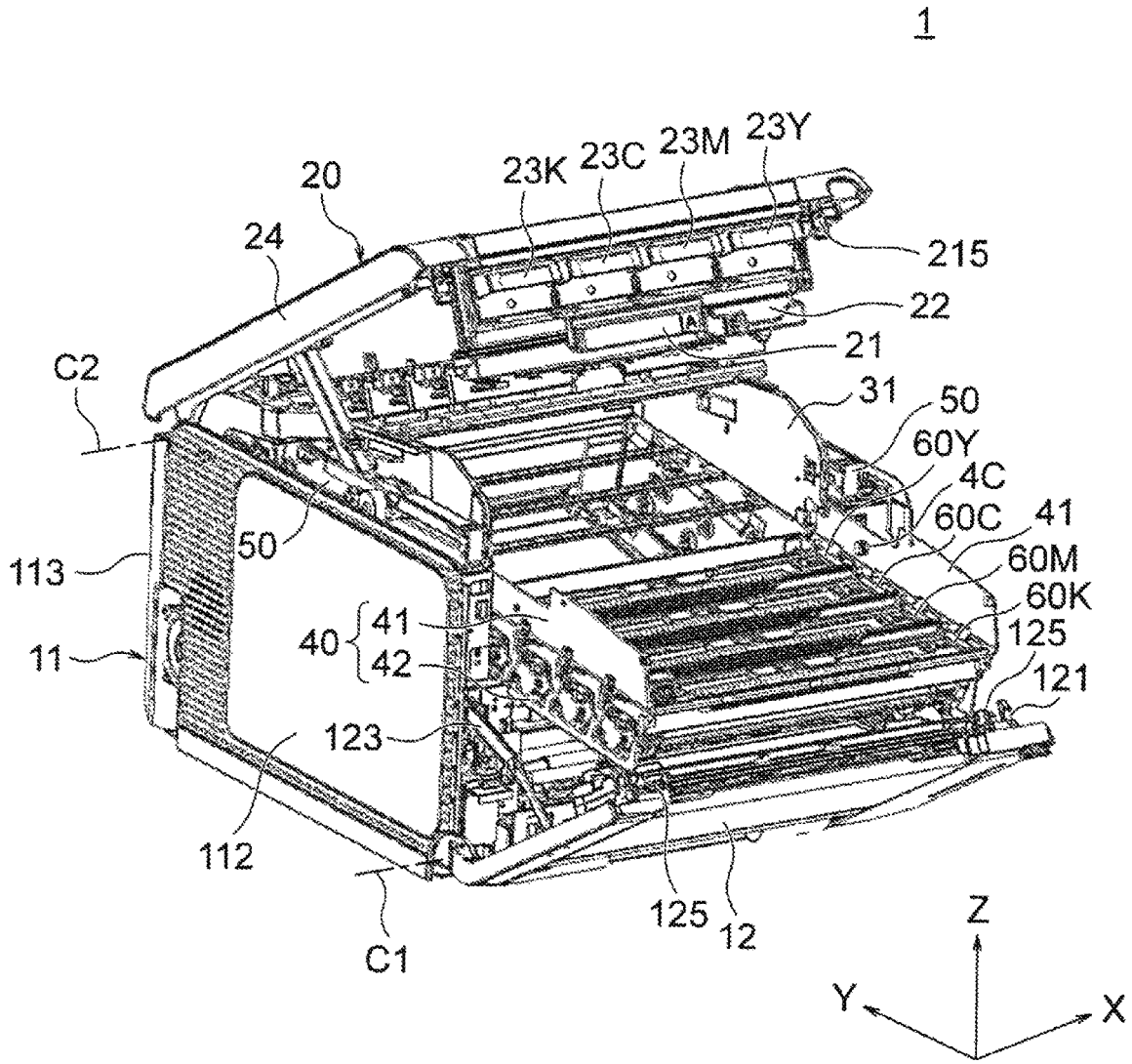
FIG. 14 is a perspective view of the image formation apparatus according to an embodiment with the front cover and the top cover unit being opened and the basket of the basket unit is pulled out.

Therefore, as illustrated in FIG. 14, the basket 40 can be pulled out in the −Y direction from the rotatable frame 30 without colliding with other components. The stay mechanism 50 is configured to withstand an external force (for example, 15 kgf) that acts when the process units 60K, 60C, 60M, and 60Y held by the basket 40 are replaced.

Next, the operation of pulling out the basket 40 is described. FIGS. 15A to 15E are schematic views illustrating the operation of pulling out the basket 40 from the rotatable frame 30.

Figure 15A:
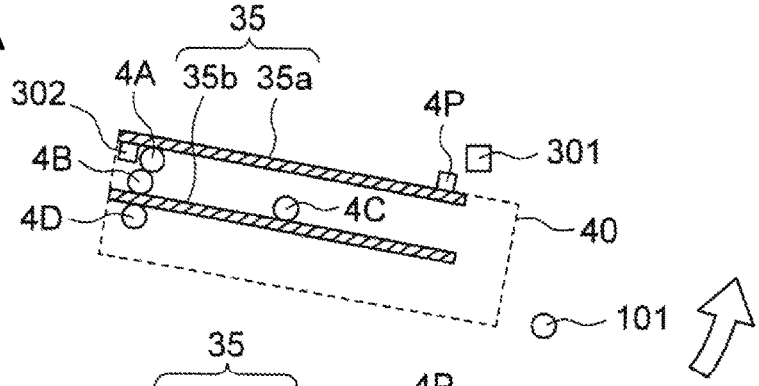
FIGS. 15A to 15E are schematic diagrams for explaining a pulling-out operation of the basket according to an embodiment.

FIG. 15A is a schematic view illustrating a state before the basket unit 3 is rotated with the rotation of the top cover unit 20. In other words, FIG. 15A illustrates the state where the basket 40 is in the accommodation position.

When the basket 40 is in the accommodation position, the rotatable member 4A of the basket 40 is in contact with the stopper 302. Further, the basket 40 is supported by the rotatable members 4B and 4C since the rotatable members 4B and 4C are in contact with the lower rail portion 35*b* of the slide rail 35 of the rotatable frame 30. That is, the rotatable members 4B and 4C support the basket 40.

The rotatable members 4A and 4D restricts the position of the basket 40 in the +Z direction. The post 4P restricts the position of the front end portion (end portion in the −Y direction) of the basket 40 in the −Z direction.

Figure 15B:
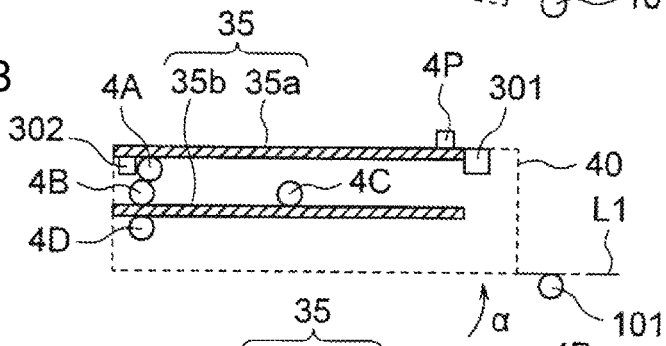

As illustrated in FIG. 15B, when the basket unit 3 is rotated by the angle α (for example, 6 degrees) with the top cover unit 20 being opened, the rotatable member 101 is positioned on the extension line L1 of the lower end portion of the basket 40.

In this state, the basket 40 is continuously supported by the rotatable members 4B and 4C in contact with the lower rail portion 35*b* of the slide rail 35 of the rotatable frame 30. That is, the rotatable members 4B and 4C support the basket 40.

Figure 15C:
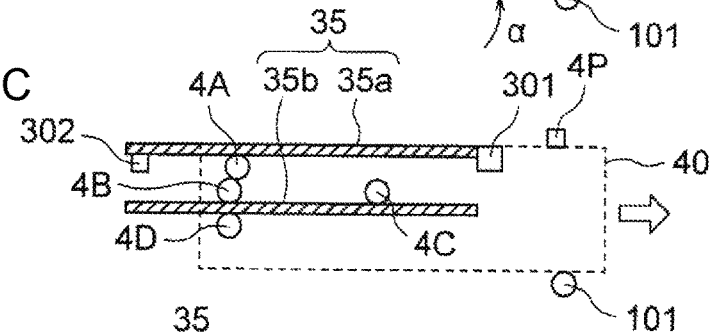

As illustrated in FIG. 15C, when the user pulls out the basket 40 in the −Y direction by, for example, 50 mm from the position illustrated in FIG. 15B, the lower end of the basket 40 comes in contact with the rotatable member 101 of the housing 11.

Figure 16:
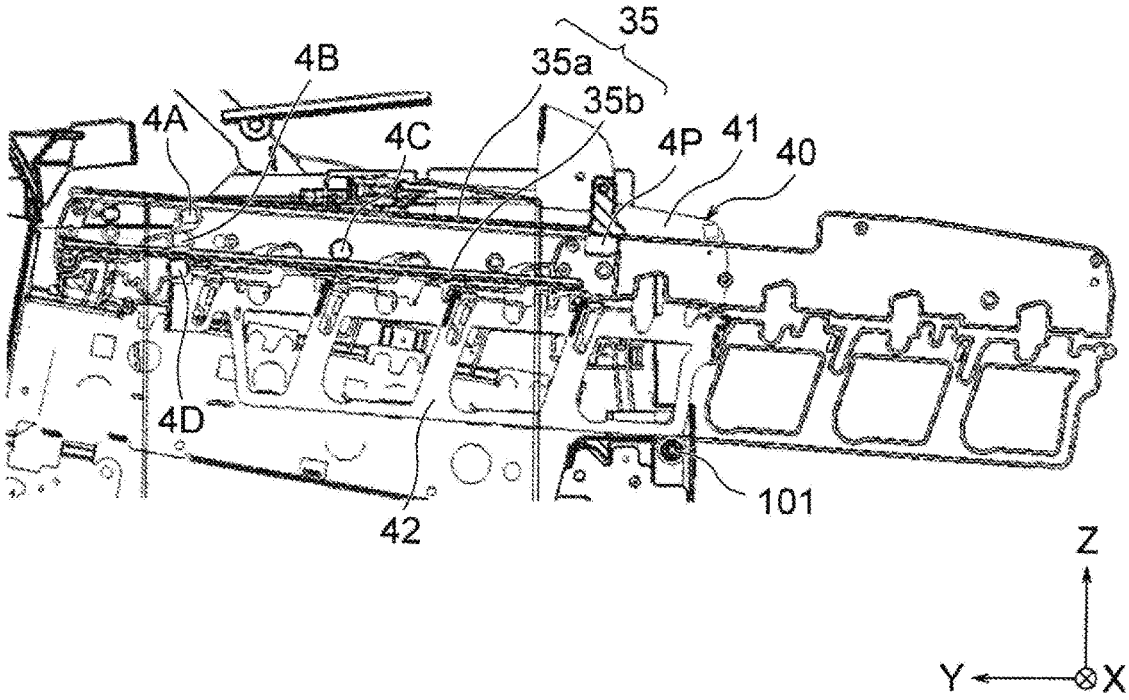
FIG. 16 is a side view of a part of the image formation apparatus for explaining the pulling-out operation of the basket according to an embodiment.

That is, the basket 40 is supported by the rotatable members 4B and 4C that is in contact with the lower rail portion 35*b* of the slide rail 35 and the lower end portion of the basket 40 that is in contact with the rotatable member 101. In other words, the rotatable members 4B and 4C and the rotatable member 101 support the basket 40. FIG. 16 illustrates the basket 40, the slide rail 35, and the surroundings thereof in the state where the lower end of the basket 40 is in contact with the rotatable member 101 (FIG. 15C).

Figure 15D:
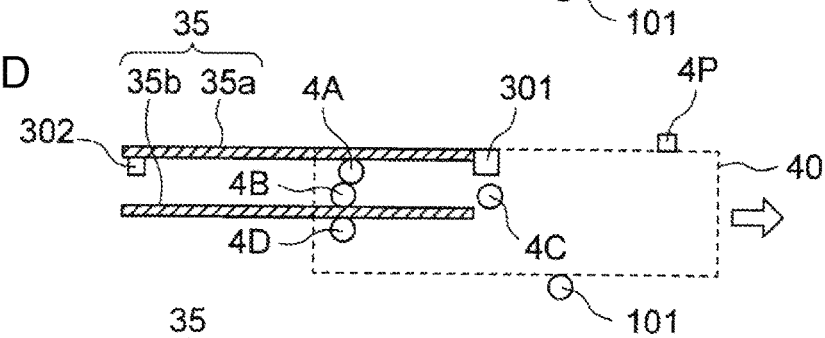

When the user pulls out the basket 40 in the −Y direction by, for example, 165 mm, the rotatable member 4C comes off the slide rail 35 in the −Y direction, as illustrated in FIG. 15D. That is, the basket 40 is supported by the rotatable member 4B that is in contact with the lower rail portion 35*b* of the slide rail 35 and the lower end portion of the basket 40 that is in contact with the rotatable member 101. In other words, the rotatable member 4B and the rotatable member 101 support the basket 40.

Figure 15E:
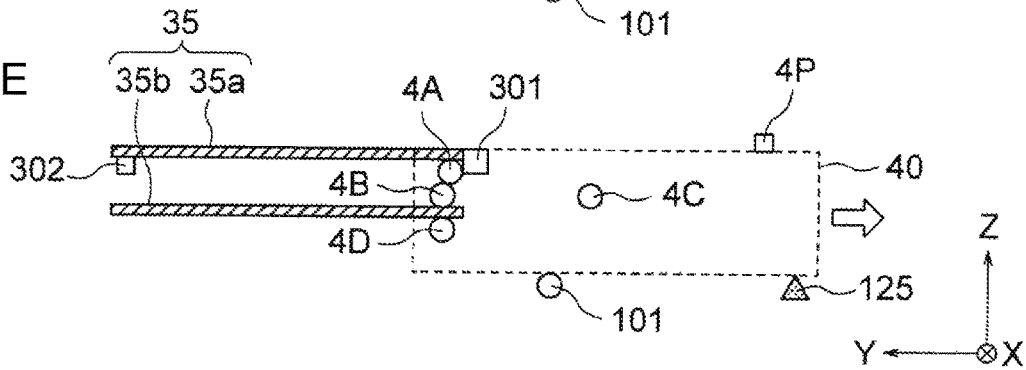

When the user pulls out the basket 40 in the −Y direction by, for example, 225 mm, the rotatable member 4A comes into contact with the stopper 301 as illustrated in FIG. 15E. That is, the basket 40 cannot be pulled out any more. The basket 40 is supported by the rotatable member 4B that is in contact with the lower rail portion 35*b* of the slide rail 35 and the lower end portion of the basket 40 that is in contact with the rotatable member 101. In other words, the rotatable member 4B and the rotatable member 101 support the basket 40.

In this way, one or more of the process units 60 can be removed from the basket 40 in the state where the basket 40 is pulled out from the rotatable frame 30. In this state, the reception portion 125 of the front cover 12 are also in contact with the lower end portion of the basket 40.

Figure 17:
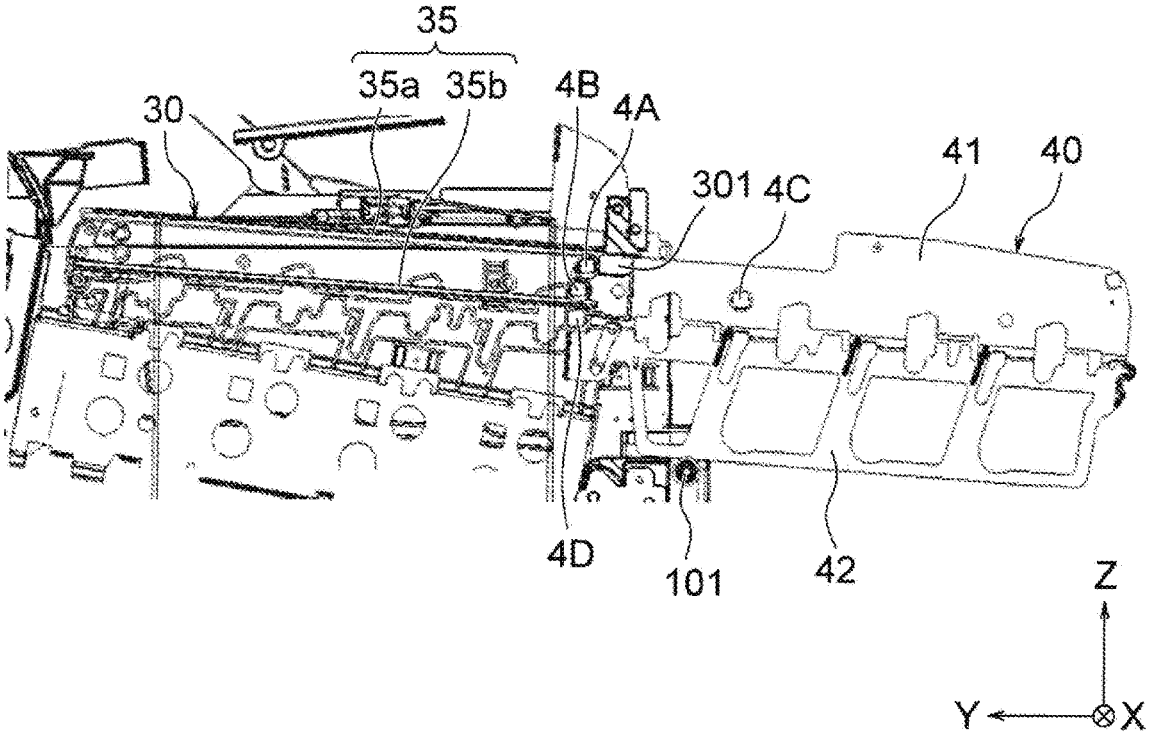
FIG. 17 is a diagram illustrating a side view of a part of the image formation apparatus for explaining the pulling-out operation of the basket according to an embodiment.

The reception portion 125 of the front cover 12 has an auxiliary role of supporting the basket 40. Therefore, one or more of the process units 60 can be replaced in a stable state. FIG. 17 illustrates the basket 40, the slide rail 35, and their surroundings in the state where the basket 40 is fully pulled out from the rotatable frame 30 (FIG. 15D).

The user may lift the front end portion of the basket 40 in the +Z direction during the pulling-out operation illustrated in FIGS. 15B to 15E. In the case, the rotatable member 4D comes into contact with the lower surface of the lower rail portion 35*b* of the slide rail 35, and thus the rotation of the basket 40 is also restricted.

In addition, the pull-out amount (stroke) of the basket 40 is, for example, 225 mm. This is less than 232 mm, which is the total of the arrangement pitches (58 mm) of the process units 60K, 60C, 60M, and 60Y. Since the process units 60K, 60C, 60M, and 60Y can be exchanged with such a short pull-out amount (stroke), the image formation apparatus 1 can be downsized and the installation space can be minimized.

After replacing one or more of the process units 60, the user pushes the basket 40 in the +Y direction along the rotatable frame 30. As a result, the basket 40 is separated from the reception portions 125 and the rotatable member 101, and the rotatable member 4C comes in contact with the lower rail portion 35*b* of the slide rail 35 (FIGS. 15C and 15D).

When the user further pushes the basket 40 in the +Y direction, the rotatable member 4A comes into contact with the stopper 302 (FIG. 15B).

After that, the user closes the top cover unit 20 by pushing, for example, the upper surface of the top cover unit 20 in the −Z direction. When the top cover unit 20 is closed, the basket unit 3 is rotated by the angle α (for example, 6 degrees) by the stay mechanism 50, and the basket 40 returns to the accommodation position illustrated in FIG. 15A.

Then, the user pushes the second operation lever 22 in the −Y direction. As a result, the toner transport paths to the process units 60K, 60C, 60M, 60Y are opened and, the top cover unit 20 and the basket unit 3 are coupled with each other.

Further, the user pushes the first operation lever 21 in the −Y direction. As a result, the lock portions 215 of the first operation lever 21 engage with the openings 115 of the housing 11, and thus the top cover unit 20 is locked with respect to the housing 11.

Effects

As described above, the image formation apparatus 1 according to an embodiment includes: the housing (apparatus body) 11; the process units (image formation units) 60; the basket (movable unit) 40 housed in the housing 11 and holding the process units 60; the slide rail (guide part) 35 that guides the basket 40 in the predetermined pull-out direction from the housing 11; the rotatable member (first rotatable member) 101 that is provided to the housing 11 and configured to guide the basket 40 in the pulling-out direction; and the rotatable member (second rotatable member) 4C that is provided to the basket 40 and configured to engage with the slide rail 35 on the upstream side of the rotatable member 101 in the pulling-out direction. When the basket 40 is moved in the pull-out direction and is guided by the rotatable member 101, the engagement between the rotatable member 4C and the slide rail 35 is released.

In this way, since it is not necessary to use a stretchable slide rail in which a plurality of slide rail parts are combined, it is possible to realize a configuration capable of pulling-out the basket 40 without increasing the size of the image formation apparatus 1. Further, since each of the pair of slide rails 35 are formed of a single member, the number of parts can be reduced and the manufacturing cost can be reduced.

Further, since the rotatable member 4C is arranged between the two process units 60M and 60Y, the rotatable member 4C does not hinder the attachment and detachment of the process units 60M and 60Y.

Since the rotatable member 4C is configured to come in contact with the slide rail 35 (more specifically, the lower rail portion 35*b* of the slide rail 35) from above, the basket 40 can be supported by the contact between the rotatable member 4C and the slide rail 35.

Further, since the rotatable member 101 is configured to come in contact with the lower surface of the basket 40 (more specifically, the lower surface of the frame portion 42 of the basket 40), the basket 40 can be supported by the contact between the rotatable member 101 and the basket 40.

Further, since the basket 40 is provided with the rotatable member (third rotatable member) 4A configured to be engaged with the slide rail 35, the basket 40 can be positioned with respect to the slide rail 35 by the contact between the rotatable member 4A and the slide rail 35.

Further, since the stoppers 301 and 302, which restrict the movement of the basket 40 in the pull-out direction (−Y direction) and the opposite direction (+Y direction) by being in contact with the rotatable member 4A, are provided, the movable range of the basket 40 can be accurately specified (restricted).

Further, since the basket 40 is provided with the rotatable member (fourth rotatable member) 4B configured to be engaged with the slide rail 35 on the upstream side of the rotatable member 4C in the pull-out direction, the rotatable member 4B and the rotatable member 4C or the rotatable member 101 can guide the basket 40.

Further, the rotatable member 4D that restricts the rotation of the basket 40 around the rotatable member 4A or the rotatable member 4B is further provided, the rotation of the basket 40 can be restricted even when the user trying to lift the basket 40 during the operation of pulling out the basket 40.

Moreover, since the rotatable member 4D is rotatable, the basket 40 can be moved smoothly.

Further, since the rotatable members 4A, 4B, and 4D are arranged near the upstream end of the basket 40 in the pull-out direction, the rotatable members 4A, 4B, and 4D can be arranged in a small space.

Further, since the rotatable members 4A, 4B, and 4D are arranged between the fixation device 75 and the process unit 60Y, the rotatable members 4A, 4B, and 4D do not hinder the attachment and detachment of the process unit 60Y.

Further, since the rotatable members 4A, 4B, and 4C are arranged between the pair of rail portions 35*a* and 35*b* of the slide rail 35, the basket 40 can be guided and the rotation of the basket 40 can be restricted with a compact structure.

Further, since the front cover 12 is provided with the reception portions 125 which receive the basket 40 that is pulled out from the housing 11, even if an external force is applied to the basket 40 during replacement of one or more of the process units 60, the image formation apparatus 1 can withstand the applied external force.

Further, since the basket 40 is provided with the post (contact portion) P that abuts the slide rail 35 in the state where the basket 40 is accommodated in the housing 11, the position of the basket 40 is restricted to the accommodation position.

Further, the image formation apparatus 1 includes the basket unit 3 including the basket 40 and the rotatable frame 30, and the top cover unit 20, wherein, when the top cover unit 20 is rotated by the first angle, the stay mechanism 50 causes the basket unit 3 to rotate by the second angle smaller than the first angle. Accordingly, the basket 40 can be pulled out without colliding with other components (for example, the conveyance roller 86).

Note that in one or more embodiments described above, the configuration for opening and closing the top cover unit 20 and the basket unit 3 has been described. However, the configuration is not limited to such a configuration as long as the basket 40 (movable unit) can be pulled out from the housing 11 to the outside of the housing 11.

Further, in one or more embodiments described above, when the top cover unit 20 is opened or closed with being decoupled from the basket unit 3, the stay mechanism 50 causes the basket unit 3 to rotate by the rotation angle smaller than the rotation angle of the top cover unit 20. However, the basket unit 3 does not have to be rotated.

Further, in one or more embodiments described above, the toner transport path connects the toner cartridge 23 and each process unit 60, but the toner cartridge 23 may be directly attached to the corresponding process unit 60.

In one or more embodiments described above, the arrangement direction of the process units 60K, 60C, 60M and 60Y and the arrangement direction of the toner cartridges 23K, 23C, 23M and 23Y are orthogonal to each other, but the arrangement directions may be parallel to each other.

Further, in one or more embodiments described above, the image formation apparatus 1 includes the process units 60K, 60C, 60M, and 60Y that form the toner images of black, cyan, magenta, and yellow, but the colors of the toner images may be arbitrary and the image formation apparatus 1 may include a single process unit and a single toner cartridge to form a toner image of a single color.

Further, the invention can be applied to an image formation apparatus of various types (for example, a copying machine, a facsimile machine, a printer, a multifunction peripheral, etc.) that forms an image on a medium by using an electrophotographic method.

The invention includes other embodiments or modifications in addition to the above-described one or more embodiments without departing from the spirit of the invention. The one or more embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

an apparatus body;

a plurality of image formation units configured to form an image;

a movable unit accommodated in the apparatus body and supporting the plurality of image formation units;

a guide part configured to guide the movable unit from an inside of the apparatus body in a pull-out direction;

a first rotatable member provided to the apparatus body and configured to guide the movable unit in the pull-out direction; and a second rotatable member provided to the movable unit and configured to be engaged with the guide part at a position on an upstream side of the first rotatable member in the pull-out direction, wherein in a state where the movable unit is guided by the first rotatable member with the movable unit being moved in the pull-out direction, the second rotatable member and the guide part are disengaged from each other, wherein the second rotatable member is provided between adjacent two, in the pull-out direction, of the plurality of image formation units.

2. The image formation apparatus according to claim 1, wherein the second rotatable member contacts the guide part from above with the second rotatable member being rotatable on the guide part.

3. The image formation apparatus according to claim 1, wherein the first rotatable member is configured to guide the movable unit while being rotated in a state where the movable unit is in contact with the first rotatable member, and the movable unit is movable along with a rotation of the first rotatable member.

4. The image formation apparatus according to claim 1, further comprising a third rotatable member provided to the movable unit and configured to be engaged with the guide part to position the movable unit with respect to the guide part.

5. The image formation apparatus according to claim 4, further comprising a first stopper configured to restrict a movement of the movable unit in the pull-out direction by coming in contact with the third rotatable member.

6. The image formation apparatus according to claim 4, further comprising a second stopper configured to restrict a movement of the movable unit in a direction opposite to the pull-out direction by coming in contact with the third rotatable member.

7. The image formation apparatus according to claim 4, further comprising a fourth rotatable member provided to the movable unit and configured to be engaged with the guide part at a position on the upstream side in the pull-out direction of the second rotatable member.

8. The image formation apparatus according to claim 7, further comprising a rotation restriction member configured to restrict a rotation of the movable unit about one of the third rotatable member and the fourth rotatable member.

9. The image formation apparatus according to claim 8, wherein the rotation restriction member is a rotatable member.

10. The image formation apparatus according to claim 8, wherein the fourth rotatable member and the rotation restriction member are provided in the vicinity of an upstream end of the movable unit in the pull-out direction.

11. The image formation apparatus according to claim 8, further comprising a fixation device configured to fix the image on a medium formed by the plurality of image formation units to the medium, wherein the third rotatable member, the fourth rotatable member, and the rotation restriction member are provided between the plurality of image formation units and the fixation device.

12. The image formation apparatus according to claim 7, wherein the guide part includes a pair of rail portions extending in the pull-out direction, and the second rotatable member, the third rotatable member, and the fourth rotatable member are provided between the pair of rail portions.

13. The image formation apparatus according to claim 12, further comprising a rotation restriction member provided on an outer side of the pair of rail portions and configured to restrict a rotation of the movable unit about one of the third rotatable member and the fourth rotatable member.

14. The image formation apparatus according to claim 1, further comprising:

a front cover provided at a front surface of the apparatus body and configured to be opened and closed with respect to the apparatus body; and a reception portion provided to the front cover and configured to receive the movable unit that is pulled out from the apparatus body.

15. The image formation apparatus according to claim 1, wherein the movable unit further includes a contact portion configured to be in contact with the guide part in the state where the movable unit is accommodated in the apparatus body.

16. An image formation apparatus comprising:

an apparatus body;

an image formation unit configured to form an image;

a movable unit accommodated in the apparatus body and supporting the image formation unit;

a rotatable frame being rotatably supported on the apparatus body;

a guide part provided at the rotatable frame and configured to support the movable unit and guide the movable unit from an inside of the apparatus body in a pull-out direction;

a first rotatable member provided to the apparatus body and configured to guide the movable unit in the pull-out direction; and a second rotatable member provided to the movable unit and configured to be engaged with the guide part at a position on an upstream side of the first rotatable member in the pull-out direction, wherein in a state where the movable unit is guided by the first rotatable member with the movable unit being moved in the pull-out direction, the second rotatable member and the guide part are disengaged from each other.

17. The image formation apparatus according to claim 16, further comprising:

a top cover unit rotatably provided at an upper portion of the apparatus body;

an open and close unit including the movable unit, and the rotatable frame supporting the movable unit; and a stay mechanism configured, when the top cover unit is rotated by a first angle, to rotate the open and close unit by a second angle smaller than the first angle.

18. The image formation apparatus according to claim 17, wherein the movable unit is able to be pulled out from the rotatable frame in a state where the open and close unit is rotated by the second angle by the stay mechanism.

19. The image formation apparatus according to claim 17, wherein the first rotatable member is provided at a position where the first rotatable member is contactable with the movable unit in a state where the open and close unit is rotated by the second angle by the stay mechanism.

20. The image formation apparatus according to claim 17, wherein the guide part is provided to the rotatable frame.

* * * * *